US011427376B2

(12) United States Patent
Vanderwell et al.

(10) Patent No.: US 11,427,376 B2
(45) Date of Patent: Aug. 30, 2022

(54) PACKAGING INSERT FOR AN ADVENT CALENDAR AND/OR BEER PACKAGING CONTAINER

(71) Applicant: CRAFT BEER IMPORTERS CANADA INC., Calgary (CA)

(72) Inventors: Janice Vanderwell, Calgary (CA); Jeffrey William Mills, Guelph (CA)

(73) Assignee: CRAFT BEER IMPORTERS CANADA INC., Calgary (CA)

( * ) Notice: Subject to any disclaimer, the term of this patent is extended or adjusted under 35 U.S.C. 154(b) by 158 days.

(21) Appl. No.: 16/321,944

(22) PCT Filed: Jul. 21, 2017

(86) PCT No.: PCT/IB2017/054448

§ 371 (c)(1),
(2) Date: Jan. 30, 2019

(87) PCT Pub. No.: WO2018/025114

PCT Pub. Date: Feb. 8, 2018

(65) Prior Publication Data

US 2019/0177031 A1 Jun. 13, 2019

Related U.S. Application Data

(60) Provisional application No. 62/369,420, filed on Aug. 1, 2016.

(51) Int. Cl.

| | |
|---|---|
| ***B65D 5/50*** | (2006.01) |
| ***B42D 5/04*** | (2006.01) |
| *A63F 9/00* | (2006.01) |

(52) U.S. Cl.

CPC ..... *B65D 5/5038* (2013.01); *B42D 5/047* (2013.01); *B65D 5/50* (2013.01); *A63F 2009/0061* (2013.01)

(58) Field of Classification Search

CPC ..... B65D 5/5038; B65D 5/0095; B65D 5/32; B65D 5/48002; B65D 5/50; B65D 5/5002;

(Continued)

(56) References Cited

U.S. PATENT DOCUMENTS 1,270,095 A * 6/1918 Baehr ..... A47B 73/00 211/74
D130,065 S 10/1941 Di Rico et al.

(Continued)

FOREIGN PATENT DOCUMENTS

DE 197 36 287 9/1998
DE 202005014806 11/2005

(Continued)

OTHER PUBLICATIONS

Office Action, dated Jun. 17, 2020 in counterpart Chinese Patent Application CN 201780048214.8.

(Continued)

*Primary Examiner* — Robert Poon
(74) *Attorney, Agent, or Firm* — Greenblum & Bernstein, P.L.C.

(57) ABSTRACT

A packaging insert includes first and second insert members each having a first layer or surface including at least one first container receiving opening and a second layer or surface spaced from the first layer or surface and includes at least one second container receiving opening. The at least one first container receiving opening is offset from said at least one second receiving opening so as to retain an inserted container in an angular orientation. At least the first container receiving opening is sized and configured to receive two different types of containers. A method making and using the same is also disclosed.

20 Claims, 22 Drawing Sheets

(58) Field of Classification Search
CPC .... B65D 5/5061; B65D 5/5059; B65D 71/40; B65D 71/48; B65D 77/0426
USPC ..... 206/763, 733, 765, 141, 139, 142–144, 206/175, 193, 199, 200, 427, 428, 430, 206/443, 489
See application file for complete search history.

(56) References Cited

U.S. PATENT DOCUMENTS

| | | | | | |
|---|---|---|---|---|---|
| 2,654,469 | A * | 10/1953 | Fulmer | B65D 5/5038 | 206/747 |
| 2,771,232 | A * | 11/1956 | Reed | A47G 23/0641 | 294/159 |
| D182,112 | S | 2/1958 | Frankel | | |
| D183,567 | S | 9/1958 | Hagan | | |
| D206,494 | S | 12/1966 | Watts | | |
| 3,404,805 | A * | 10/1968 | Stockman | B65D 21/0204 | 206/144 |
| 3,838,806 | A | 10/1974 | Dogliotti | | |
| D236,436 | S | 8/1975 | Fischer | | |
| 3,949,930 | A | 4/1976 | Giordano | | |
| 3,987,892 | A * | 10/1976 | Killy | B65D 5/5023 | 206/563 |
| 4,004,691 | A | 1/1977 | Wihksne | | |
| 4,053,099 | A | 10/1977 | Lock | | |
| 4,269,309 | A | 5/1981 | Prodel | | |
| 4,286,709 | A * | 9/1981 | Manizza | B65D 71/0022 | 229/117.14 |
| D268,251 | S | 3/1983 | Savage | | |
| 5,069,335 | A * | 12/1991 | Beales | B65D 5/427 | 206/190 |
| 5,221,001 | A * | 6/1993 | Eisman | B65D 71/0077 | 206/190 |
| 5,495,703 | A | 3/1996 | Kruit | | |
| 5,590,776 | A | 1/1997 | Gelbierz | | |
| 5,611,425 | A | 3/1997 | Holley | | |
| D386,073 | S | 11/1997 | Hanson | | |
| 5,765,690 | A | 6/1998 | Baxter | | |
| 5,797,486 | A * | 8/1998 | Picciolo | B65D 71/48 | 206/162 |
| 5,878,876 | A * | 3/1999 | Galbierz | B65D 71/48 | 206/148 |
| 6,068,127 | A | 5/2000 | Hunter | | |
| 6,186,553 | B1 | 2/2001 | Phillips | | |
| 6,386,370 | B1 * | 5/2002 | Wigton | B42D 15/042 | 206/486 |
| 6,702,115 | B1 * | 3/2004 | Roper | B65D 5/5071 | 206/427 |
| D494,060 | S | 8/2004 | Izen | | |
| D496,275 | S | 9/2004 | Hamuro | | |
| D499,020 | S | 11/2004 | Izen | | |
| D513,596 | S | 1/2006 | Hamblin | | |
| D515,941 | S | 2/2006 | Hamblin | | |
| D515,942 | S | 2/2006 | Hamblin | | |
| D515,943 | S | 2/2006 | Hamblin | | |
| D533,078 | S | 12/2006 | Lebras | | |
| D557,135 | S | 12/2007 | Demalschee | | |
| D600,447 | S | 9/2009 | Sullivan | | |
| 7,661,530 | B1 | 2/2010 | Hewitt | | |
| D636,665 | S | 4/2011 | Mittelstaedt | | |
| D642,456 | S | 8/2011 | Mittelstaedt | | |
| D643,741 | S | 8/2011 | Kaneko | | |
| D643,747 | S | 8/2011 | Rye | | |
| D660,701 | S | 5/2012 | Cox | | |
| D668,545 | S | 10/2012 | Cox | | |
| D673,864 | S | 1/2013 | Read | | |
| D684,049 | S | 6/2013 | McCarthy | | |
| D693,678 | S | 11/2013 | Kanchan | | |
| D706,640 | S | 6/2014 | Lee | | |
| D707,552 | S | 6/2014 | Ahn | | |
| D708,959 | S | 7/2014 | Lee | | |
| D709,364 | S | 7/2014 | Olsson | | |
| D709,775 | S | 7/2014 | Perkins | | |
| D729,073 | S | 5/2015 | Wasilewski | | |
| D743,247 | S | 11/2015 | Solovov | | |
| D756,804 | S | 5/2016 | Gross | | |
| D758,851 | S | 6/2016 | Binder | | |
| D772,057 | S | 11/2016 | Adams | | |
| D772,061 | S | 11/2016 | O'Dowd | | |
| D786,677 | S | 5/2017 | Griffith | | |
| D787,320 | S | 5/2017 | Gill | | |
| D817,783 | S | 5/2018 | Chang | | |
| D871,924 | S | 1/2020 | Vanderwell et al. | | |
| 2003/0106828 | A1 | 6/2003 | Hunter | | |
| 2003/0163936 | A1 | 9/2003 | Floss | | |
| 2003/0209454 | A1 | 11/2003 | Hunter | | |
| 2004/0055908 | A1 * | 3/2004 | Cuomo | B65D 71/0077 | 206/198 |
| 2006/0024410 | A1 | 2/2006 | Krivanek | | |
| 2006/0169602 | A1 | 8/2006 | Woog | | |
| 2006/0278559 | A1 | 12/2006 | Hamblin | | |
| 2009/0007467 | A1 | 1/2009 | Bowman | | |
| 2009/0223971 | A1 | 9/2009 | Moffett | | |
| 2010/0127058 | A1 | 5/2010 | Bates | | |
| 2012/0085767 | A1 | 4/2012 | Read | | |
| 2014/0008250 | A1 | 1/2014 | Picciolo | | |
| 2015/0108035 | A1 | 4/2015 | Delforte | | |

FOREIGN PATENT DOCUMENTS

| | | |
|---|---|---|
| DE | 202006011123 | 10/2006 |
| DE | 202016002640 | 6/2016 |
| EM | 001624362-0001 | 10/2009 |
| EM | 003714005-0008 | 1/2017 |
| EP | 0269761 | 8/1988 |
| EP | 2052983 | 4/2009 |
| FR | 1300969 | 10/1962 |
| FR | 2144566 | 2/1973 |
| FR | 2769000 | 4/1999 |
| GB | 332961 | 1/1930 |
| WO | 2015/049702 | 9/2015 |

OTHER PUBLICATIONS

Office Action, dated Feb. 8, 2021 in counterpart Chinese Patent Application CN 201780048214.8.
Office Action, dated Feb. 6, 2020 in counterpart European Patent Application EP 17 836 481.6.
International Search Report, dated Nov. 6, 2017 in International Patent Application PCT/IB2017/054448.
Written Opinion of the ISA, dated Nov. 6, 2017 in International Patent Application PCT/IB2017/054448.
International Preliminary Report on Patentability, dated Feb. 5, 2019 in International Patent Application PCT/IB2017/054448.
The Craft Beer Advent Calendar URL https://twitter.com/thebeerhuntress; Mar. 2017-Jun. 2017.
The Craft Beer Advent Calendar URL http://mamanloupsden.com/2016/11/21/beer-advent-calendar/; Nov. 21, 2016.
12 Best Advent Calendar Ideas URL http://blog.buzzbishop.com/shopping/best-advent-calendars-2014/; Nov. 11, 2014.
The 2012 Craft Beer Advent Calendar URL http://blog.buzzbishop.com/food/beer/the-craft-beer-advent-calendar/; Dec. 1, 2012.
Beery Christmas Box obtain from an internet link—undated.
Best List of Grown Up Advent Calendars URL http://dad-camp.com/grown-advent-calendars/; Nov. 18, 2013.
'Tis the Season URL http://www.thebeerblogger.ca/tis-the-season/ Nov. 28, 2013.
Der biergste Adventkalender (2011) URL http://michelleswafflings.blogspot.com/2011/12/der-bierigste-adventkalender.html; Dec. 8, 2011.
Craft Beer Advent Calendar—2013 Edition URL http://abliquorstore.com/wordpress/wp-content/uploads/2013/10/Craft-Beeradvent-Calendar.jpg_10/03/2013; Oct. 3, 2013.

* cited by examiner

PACKAGING INSERT FOR AN ADVENT CALENDAR AND/OR BEER PACKAGING CONTAINER

CROSS-REFERENCE TO RELATED APPLICATIONS

The instant application is an International Application claiming the benefit of U.S. provisional application No. 62/369,420 filed on Aug. 1, 2016, the disclosure of which is hereby expressly incorporated by reference thereto in its entirety.

BACKGROUND OF THE INVENTION

1. Field of the Invention

The invention relates to a packaging insert. In embodiments, the packaging insert assembly is sized to be insertable and/or containable in a packaging container or box serving as a, e.g., craft beer advent calendar. In embodiments, the packaging insert can safely retain 24 beer bottles and/or cans. The invention also relates to a method making and using the same.

2. Discussion of Background Information

Previous packaging for beer Advent Calendar packages have been sized to contain 24 beer bottles. These packaging inserts for such packaging were typically divided into two packing inserts that each retained 12 bottles. Although such packaging retained the beer bottles in an angled configuration, such an arrangement was found to have disadvantages. One disadvantage was that the packaging insert openings could not receive therein both cans and bottles. Some craft beers use only cans and some only bottles and each are often of different sized and volumes. Another was that the folding and inserting of two packaging inserts required more labor time and made for a less stable packaging for beer bottles inside a box.

An improved packaging would address one or more such deficiencies and would also be relatively inexpensive and easy to use and make.

SUMMARY OF THE INVENTION

According to non-limiting embodiments of the invention, there is provided a packaging insert comprising first and second insert members each comprising a first layer or surface comprising at least one first container receiving opening and a second layer or surface spaced from the first layer or surface and comprising at least one second container receiving opening. The at least one first container receiving opening is offset from said at least one second receiving opening so as to retain an inserted container in an angular orientation. At least said first container receiving opening is sized and configured to receive two different types of containers.

In embodiments, the first and second layers or surfaces are made of cardboard or fiberboard.

In embodiments, the first and second layers or surfaces are made of folded sheet material.

In embodiments, the first and second insert members comprise left-side and right-side insert members arranged side-by-side.

In embodiments, the left-side and right-side insert members are configured to be assembled together.

In embodiments, the left-side and right-side insert members have folded configurations that are substantial mirror images of one another.

In embodiments, the left-side and right-side insert members are folded from blanks that are substantial mirror images of one another.

In embodiments, the at least one first container opening comprises plural container receiving openings.

In embodiments, the at least one second container opening comprises plural container receiving openings.

In embodiments, the at least one first container opening comprises 12 container receiving openings, whereby the first and second insert members together comprise 24 container receiving openings.

In embodiments, the packaging insert is configured to store beer containers.

In embodiments, the packaging insert is disposed in a box having an advent calendar.

In embodiments, the two different types of containers comprise beverage cans and beverage bottles.

In embodiments, the two different types of containers comprise beer cans and beer bottles.

In embodiments, the invention also provides for a two-piece packaging insert comprising a left-side insert made from a cardboard or fiberboard blank comprising seven rectangular sections, six fold lines arranged parallel to one another, and one generally D-shaped handle opening arranged on one of the seven rectangular sections.

In embodiments, the invention also provides for a two-piece packaging insert comprising a left-side insert made from a cardboard or fiberboard blank comprising seven rectangular sections that include, a first rectangular section, a second rectangular section, a fold line connecting the first and second rectangular sections, a third rectangular section comprising a handle opening, a fold line connecting the second and third rectangular sections, a fourth rectangular section comprising at least one first container receiving opening and forming a left-side half of the first layer of surface, a fold line connecting the third and fourth rectangular sections, a fifth rectangular section, a fold line connecting the fourth and fifth rectangular sections, a sixth rectangular section comprising at least one second container receiving opening, a fold line connecting the fifth and sixth rectangular sections, a seventh rectangular section, and a fold line connecting the sixth and seventh rectangular sections.

In embodiments, the invention also provides for a two-piece packaging insert comprising a right-side insert made from a cardboard or fiberboard blank comprising seven rectangular sections, six fold lines arranged parallel to one another, and one generally D-shaped handle opening arranged on one of the seven rectangular sections.

In embodiments, the invention also provides for a two-piece packaging insert comprising a right-side insert made from a cardboard or fiberboard blank comprising seven rectangular sections that include, a first rectangular section, a second rectangular section, a fold line connecting the first and second rectangular sections, a third rectangular section comprising a handle opening, a fold line connecting the second and third rectangular sections, a fourth rectangular section comprising at least one first container receiving opening and forming a right-side half of the first layer of surface, a fold line connecting the third and fourth rectangular sections, a fifth rectangular section, a fold line connecting the fourth and fifth rectangular sections, a sixth rectangular section comprising at least one second container receiving opening, a fold line connecting the fifth and sixth rectangular sections, a seventh rectangular section, and a fold line connecting the sixth and seventh rectangular sections.

In embodiments, the invention also provides for a packaging insert comprising side-by-side folded insert members, plural container receiving openings arranged on spaced apart surfaces, and at least one said container receiving opening being configured to retain two types of containers in an angled orientation relative to one of the spaced apart surfaces. The two types of containers are a beverage can and a beverage bottle.

In embodiments, at least one of the plural container receiving openings comprises a generally oval shape.

In embodiments, the packaging insert is disposed in a box having an advent calendar.

In embodiments, the invention also provides for a two-piece cardboard or fiberboard packaging insert insertable into a box and being configured to store beer cans and beer bottles, wherein each two-piece packaging insert comprising a planar top or bottom surface, plural non-circular container receiving openings configured to retain a beer can or a beer bottle in an angled orientation relative to the planar top or bottom surface. At least one said container receiving opening is configured to interchangeably receive therein either or each of a beer can and/or a beer bottle.

In embodiments, at least one non-circular opening comprises at least one of two oppositely arranged concave sections or edges and/or a width of about 65 mm.

In embodiments, the invention also provides for an advent calendar package configured to store cans and bottles during shipping and use, comprising a box comprising plural removable sections, each removable section being sized and configured to allow for removal of one bottle or one can stored inside the box and a packaging insert of any one of types described herein arranged inside the box.

In embodiments, the box contains therein beer cans and/or beer bottles.

The invention is also more advantageous that prior art packages that can essentially hold only one type of container, i.e., bottles, in that it can hold all sizes of beverage containers, such as beer, —even containers up to 500 ml., not limited to smaller bottles.

The invention is also more advantageous that prior art packages in that the insert is more resistant to falling apart during shipping. The packaged containers, i.e., beer, are less likely to experience shifting around or back and forth in the box The invention is also more advantageous that prior art packages in that the openings can hold a greater variety of container, bottle and can sizes. For example, whereas the oval or egg-shaped openings are essentially limited to bottles in the 341 ml and 355 ml size range, the same openings of the invention can accommodate a larger size, number and/or type of containers such as 12 and 16 ounce cans of beer as well as 12.5 and 16 ounce bottles of beer. Exemplary container size/volumes include between 250 ml and 500 ml for beer bottles and between 355 ml and 473 ml for beer cans.

The invention is also more advantageous than prior art packages in that both bottles and/or cans are held more securely as there is less chance for them to move around—even while they are oriented at about a 30 degree angle (like a prior art packaging insert).

The invention is particularly advantageous when used as an insert for packaging a beer advent calendar. A beer advent calendar is a box which retains a number of beers—one of which can be sampled each day in, for example, December 1-24.

The invention can also be utilized in a box which can handle up to 35 pounds of beer contained therein. In embodiments, the box has integrally formed handles that do not protrude—making it less likely to get in the way and less difficult to facilitate stacking of the boxes. The handhold openings of the box can be aligned with the comparably sized openings of the packaging insert (when inserted) so as to both reinforce the box openings and all for more safe or secure lifting of the box—lifting of the box results in the simultaneous lifting of the packaging insert. The box handhold openings are thus more in the nature of reinforced hand holds arranged on the sides rather than the previously used protruding plastic handles situated on the top of the cox was has been previously the case with prior art boxes. In embodiments, two oppositely arranged hand hold openings are covered by inwardly bendable tabs that are bent inward, pass through an aligned opening of the insert, and bent upward.

The invention is also advantageous over the prior art because, while using about the same amount of cardboard, a little stronger cardboard can be used without make the insert too much heavier.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 2 shows a left-side or first insert member and FIG. 3 shows a right-side or second insert member;

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIGS. 1-25 show non-limiting embodiments of a packaging insert assembly 10 and packaging box 300 utilizing the same and which has one or more of the benefits discussed above. In embodiments, the packaging insert 10 is sized to be insertable and/or containable in a packaging container or box 300 that is about 9 inches by about 19 or 20 inches and by about 21 inches. In embodiments, the packaging container or box 300 is made of cardboard or paperboard. In embodiments, the packaging insert 10 can safely retain 24 beer bottles. In embodiments, the packaging insert 10 can safely retain 24 beer cans. In embodiments, the packaging insert 10 can safely retain one or plural beer cans and one or plural beer bottles. The invention also relates to a method making and using the same.

Figure 1:
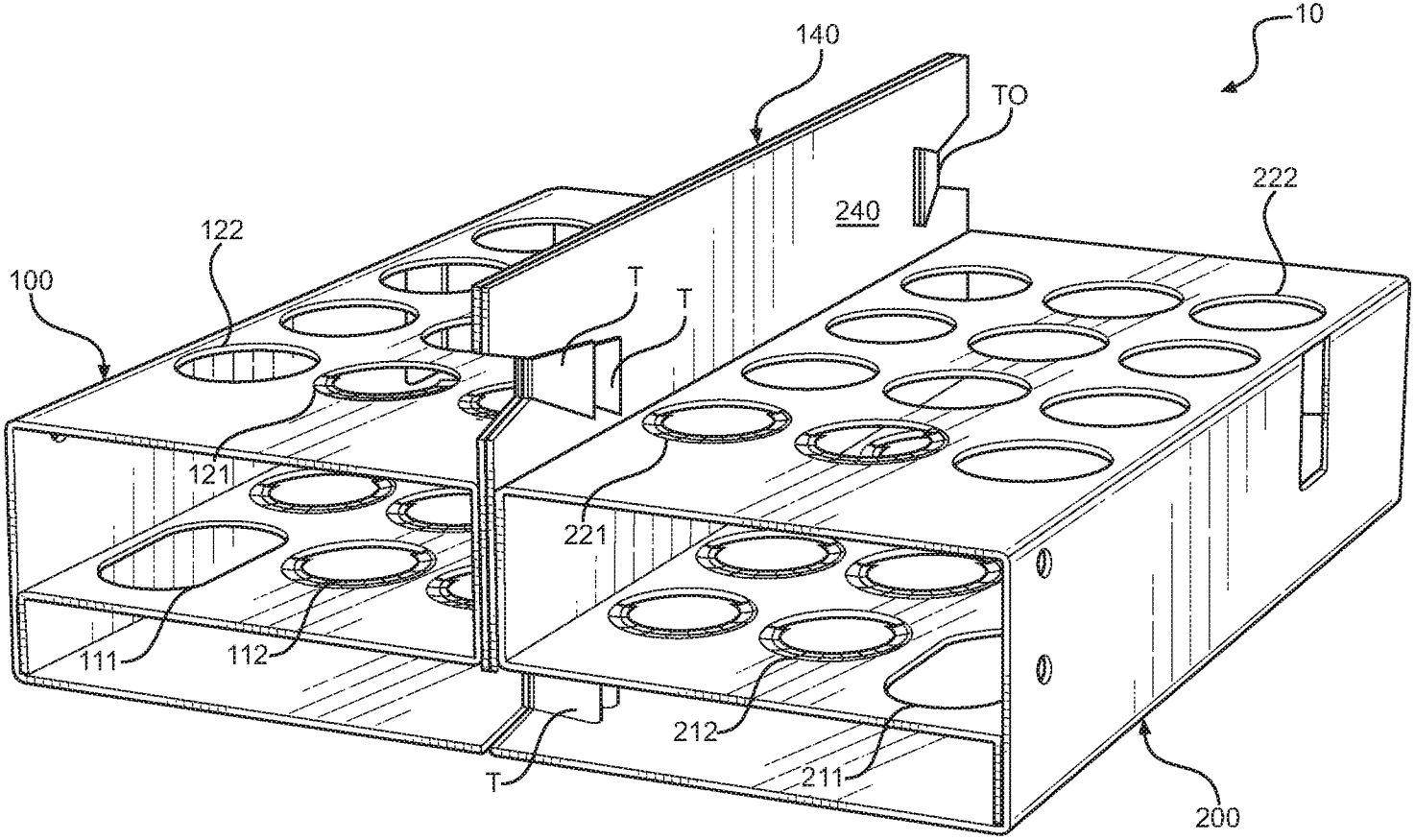
FIG. 1 shows a front top right side perspective view of a two piece insert assembly in an assembled or connected state in accordance with the invention.
Figures 2, 3:
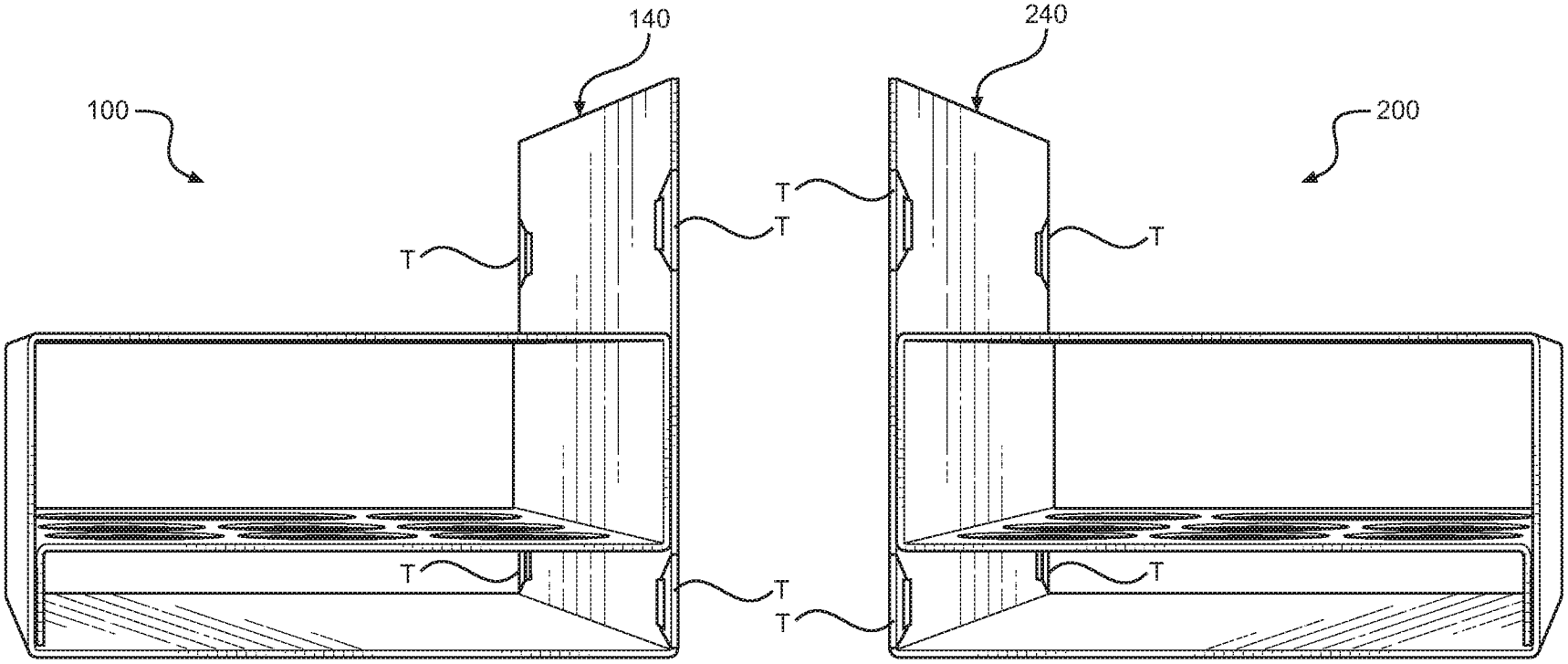
FIGS. 2 and 3 show a side perspective view of the two piece insert prior to being in an assembled or connected state in accordance with the invention.
Figure 4:
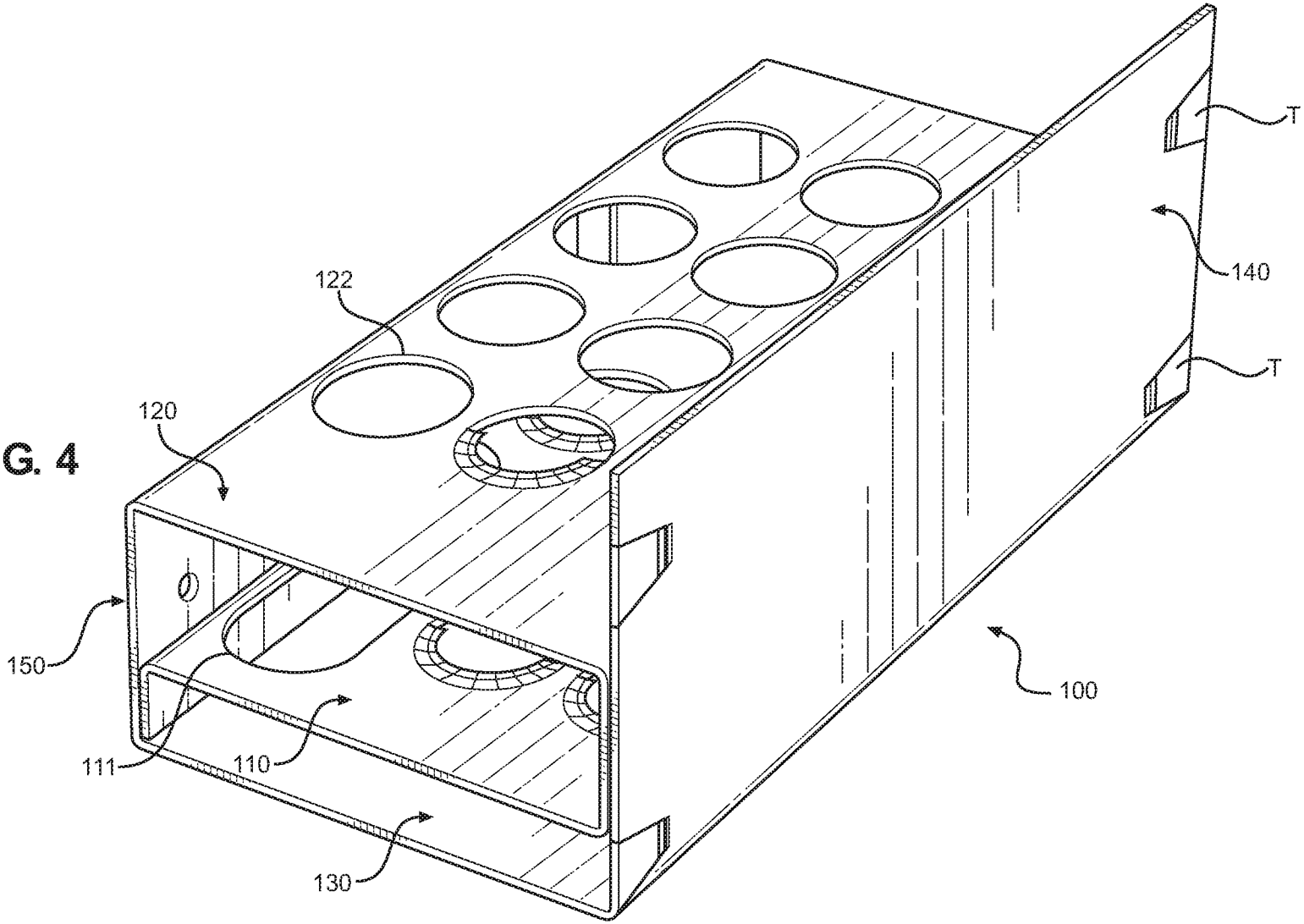
FIG. 4 shows a right side perspective view of the left-side or first insert member.
Figure 5:
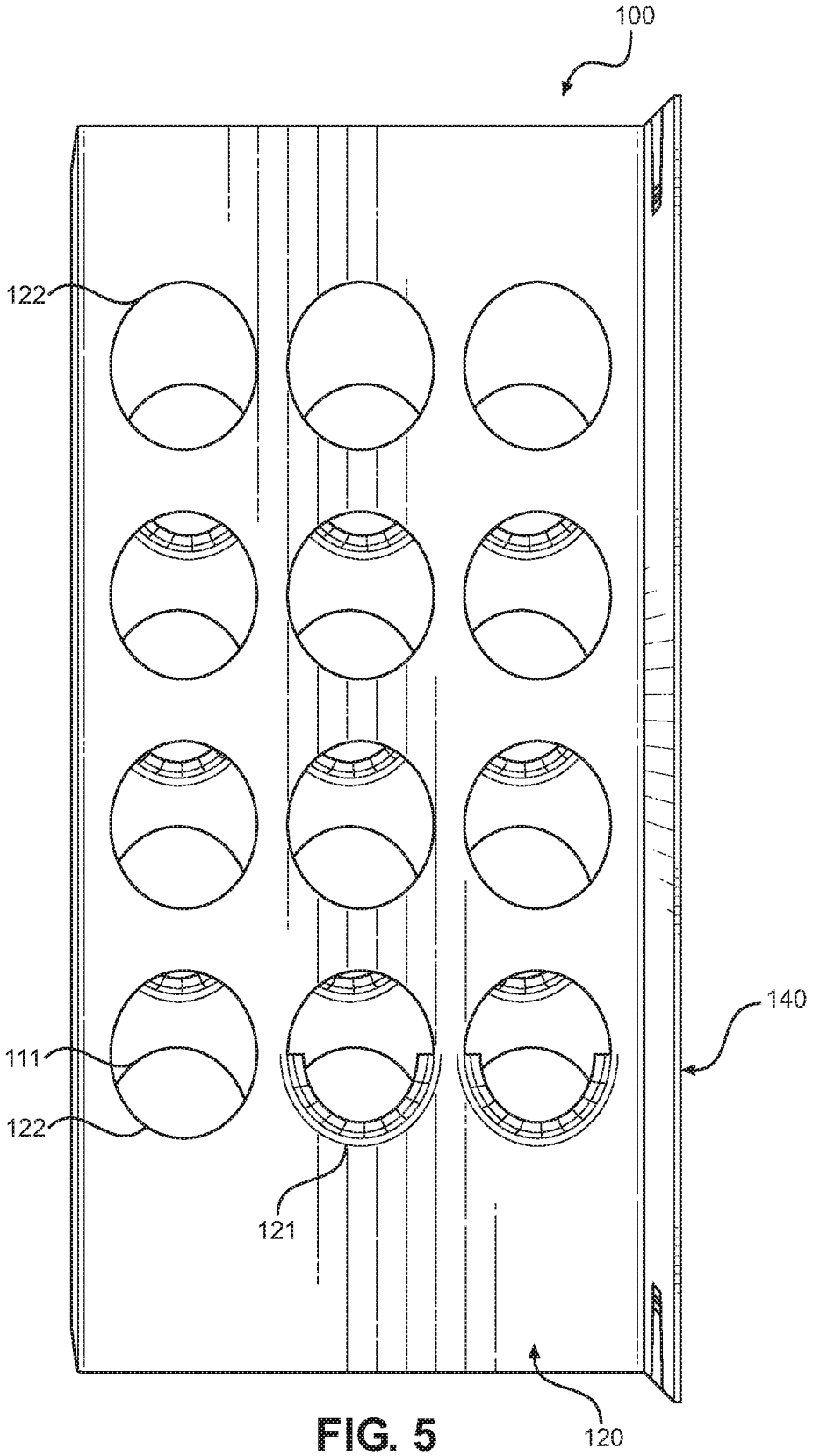
FIG. 5 shows a top left side perspective view of the left-side or first insert member.
Figure 6:
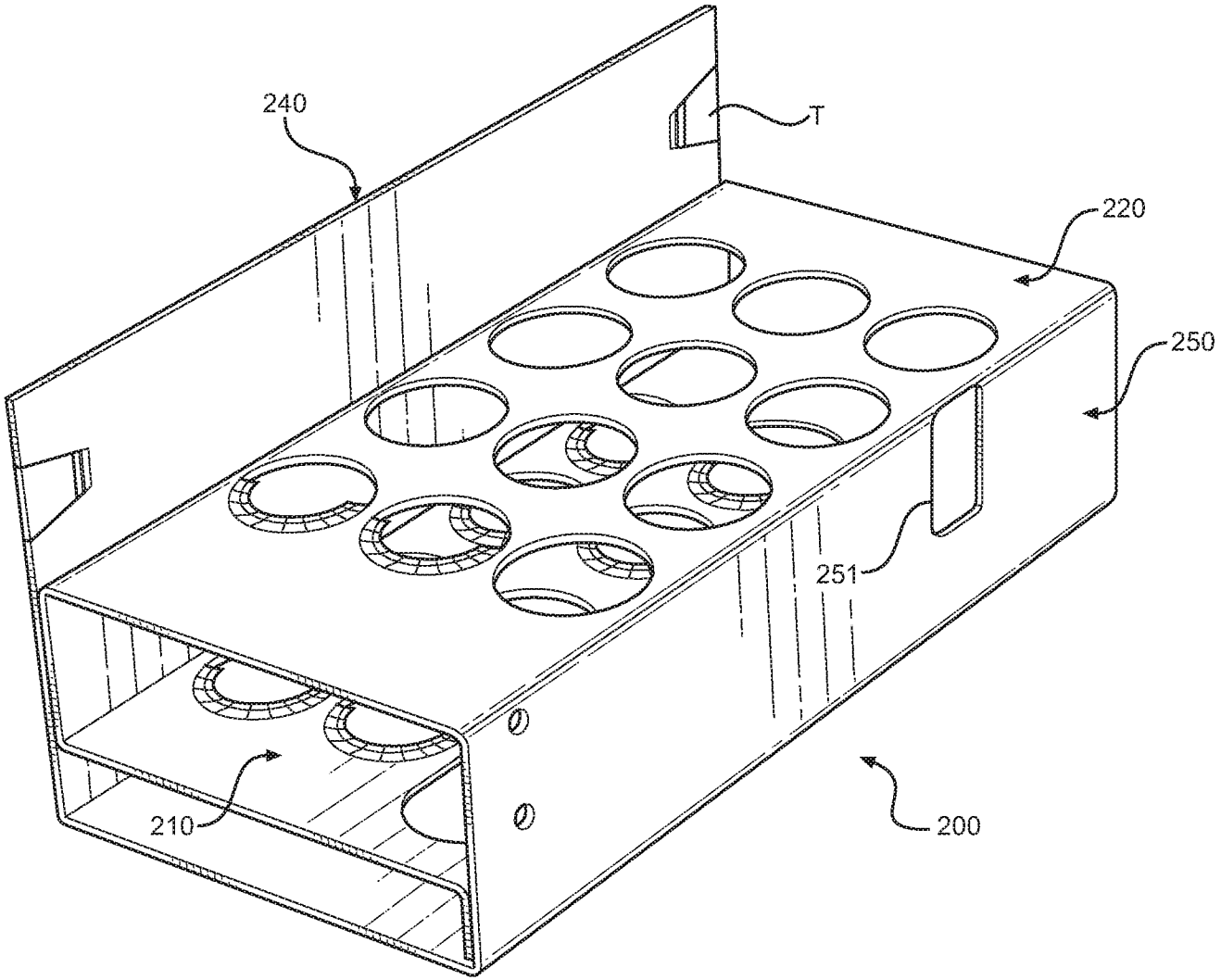
FIG. 6 shows a right side perspective view of the right-side or second insert member.
Figure 7:
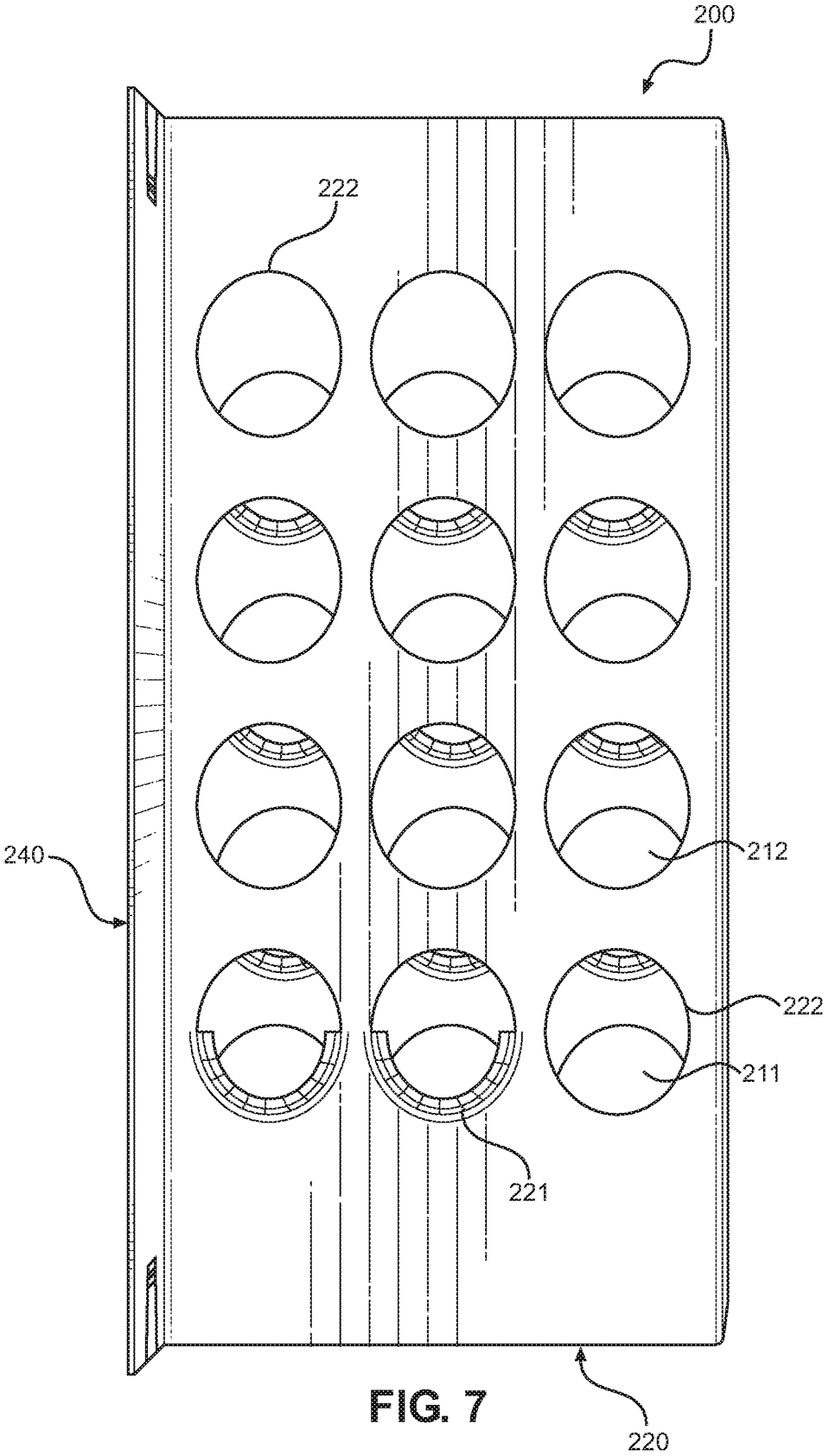
FIG. 7 shows a top right side perspective view of the right-side or second insert member.
Figure 10:
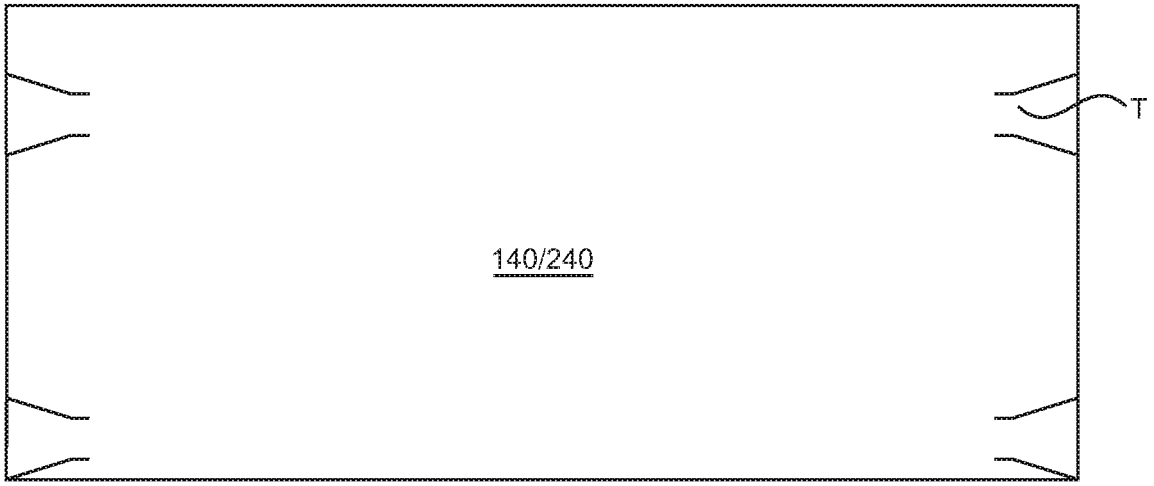
FIG. 10 shows a side view of the vertical panel side of either the lest-side or right-side insert member.
Figure 11:
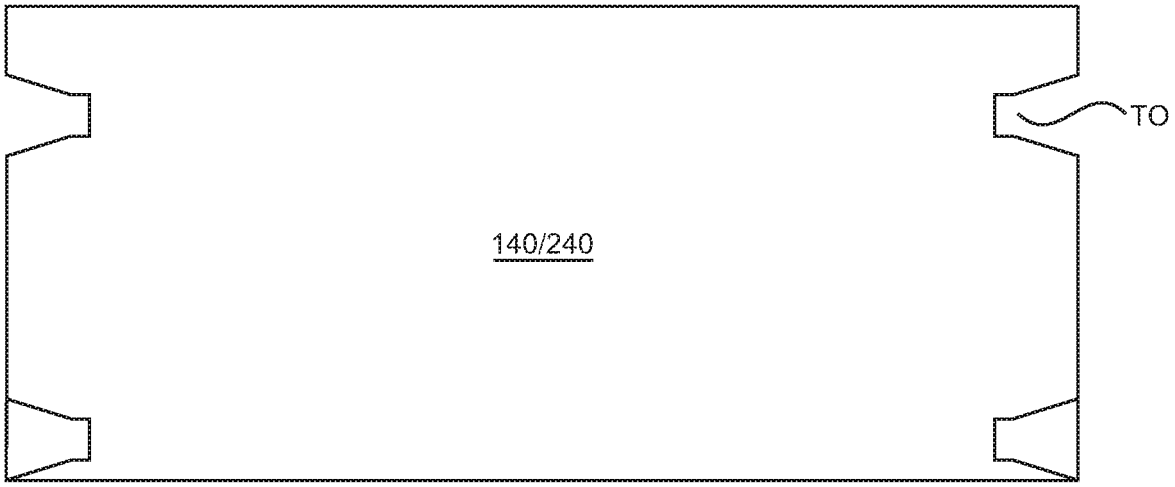
FIG. 11 shows the view of FIG. 10 but with the locking tabs folded inward 90 degrees.

With reference to FIGS. 1, 10 and 11, there is shown an assembled packaging insert 10. The insert 10 is made up of two main folded insert members which are connected together via folding over of tabs T within tab openings TO. Specifically, a vertical panel 140 of a first insert member 100 is connected to locked to a vertical panel 240 of a second insert member 200. This locking connection results when the panels 140 and 240 are placed in contact with one another so that the four locking tabs T of panel 140 align with the four locking tabs T of the panel 240. When the tabs T are then folded to one side or the other, the tabs T become locked in the tab openings TO. As a result, the insert member 100 becomes locked to the second insert member 200. Once assembled into the insert assembly 10 shown in FIG. 1, bottles and/or cans can be placed or slid into the openings and then positioned therewith into the box 300. As is apparent from FIGS. 10 and 11, each tab T has tapered sides and can fold inward or outward, and when folded 90 degrees or more inward, reveals a comparable shaped opening TO. FIG. 11 shows an example where the two top tabs T have been folded to reveal the comparable shaped openings TO. When connected together, the panels 140 and 240 also serve to properly position the insert assembly 10 inside the box 300 (see FIG. 17) by correctly spacing the layers 120 and 220 from the front side 310.

With reference to FIGS. 2-7, it can be seen how the assembled packaging insert 10 is made up of two main folded insert members 100 and 200 whose respective vertical panels 140 and 240 can be connected to one another. As should be apparent from comparing FIGS. 1 and 2, the four tabs T of panel 140 can align with the four tabs T of the panel 240 when the two insert members 100 and 200 are brought together to the point where the panel 140 of insert 100 is placed in contact with the panel 240 of the insert 200. The tabs T are arranged such that two tabs T located between surfaces or layers 110 and 130 (i.e., bottom tabs T of insert member 100) can engage with two tabs T located between surfaces or layers 210 and 230 (i.e., bottom tabs T of insert member 200), and such that two tabs T located above surface or layer 120 (i.e., top tabs T of insert member 100) can engage with two tabs T located above surface or layer 220 (i.e., top tabs T of insert member 200)

With reference to FIGS. 2-7, 14 and 16, it can be seen how the insert member 100 has an upper surface of layer 120 and a bottom surface or layer 130 with an intermediate surface or layer 110 located between the layers 120 and 130. Layers 110, 120 and 130 of insert member 10 0 are arranged generally parallel to one another with the layers 110 and 130 being spaced closer to one another layers 110 and 120. The lower layer 130 is designed to contact (or be contacted by) a bottom of an inserted bottle or can (not shown in FIGS. 2-7) and, owing to the material of the insert member 100, provides some cushioning thereto. Unlike some prior art inserts, the insert member 100 is designed to retain the bottles or cans in an angle or inclined position (rather in a vertical position). This should be evident from FIG. 5 which shows that the openings of the layer 110 and not aligned with the openings of the layer 120. For example, in the case of the lower left opening 122 shown in FIG. 5, one can discern that the opening 111 of the layer 110 is offset from the opening 122 of the layer 120. This applies to the other eleven openings as well. Thus, when a bottle or can is slid into opening 122, it will need to be slid further downward in an angled position in order to slide into opening 111. When the bottom of the bottle or can eventually contacts the layer 130, which lacks comparable openings, it is retained by this surface and by the openings 111 and 122. As should be apparent, in order accommodate both bottles or cans in angled or inclined orientations, the upper layer 120 has generally oval-shaped openings. In addition, the layer 110 also has generally oval-shaped openings. However, it was discovered that all of the openings of the layers 110 and 120 should not be same. In fact, while ten first type openings 122 of the upper layer 120 should be substantially identical or similar to one another, two second type openings 121 should be utilized in the position shown in FIG. 5. Moreover, these openings 121 can have a curved crushable zone in a lower half of the opening 121. Also, while eleven first type openings 112 of the layer 110 should be substantially identical or similar to one another, one second type (i.e., oblong) opening 111 should be utilized in the position shown in FIGS. 1 and 4. Moreover, the oblong opening 111 need not have any crushable zone whereas the other eleven openings 112 can have a curved crushable zone in a half of the opening 112.

With reference to FIGS. 2-7, 14 and 15, it can be seen how the insert member 200 also has an upper surface of layer 220 and a bottom surface or layer 230 with an intermediate surface or layer 210 located between the layers 220 and 230. Layers 210, 220 and 230 of insert member 20 0 are arranged generally parallel to one another with the layers 210 and 230 being spaced closer to one another layers 210 and 220. The lower layer 230 is designed to contact (or be contacted by) a bottom of an inserted bottle or can (not shown in FIGS. 2-7) and, owing to the material of the insert member 200, provides some cushioning thereto. As with insert member 100, the insert member 200 is designed to retain the bottles or cans in an angle or inclined position (rather in a vertical position). This should be evident from FIG. 7 which shows that the openings of the layer 210 and not aligned with the openings of the layer 220. For example, in the case of the lower right opening 222 shown in FIG. 7, one can discern that the opening 222 of the layer 220 is offset from the opening 211 of the layer 210. This applies to the other eleven openings as well. Thus, when a bottle or can is slid into opening 222, it will need to be slid further downward in an angled position in order to slide into opening 211. When the bottom of the bottle or can eventually contacts the layer 230, which lacks comparable openings, it is retained by this surface and by the openings 211 and 222. As should be apparent, in order accommodate both bottles or cans in angled or inclined orientations, the upper layer 220 has generally oval-shaped openings. In addition, the layer 210 also has generally oval-shaped openings. However, it was discovered that all of the openings of the layers 210 and 220 should not be same. In fact, while ten first type openings 222 of the upper layer 220 should be substantially identical or similar to one another, two second type openings 221 should be utilized in the position shown in FIG. 7. Moreover, these openings 221 can have a curved crushable zone in a lower half of the opening 221. Also, while eleven first type openings 212 of the layer 210 should be substantially identical or similar to one another, one second type (i.e., oblong) opening 211 should be utilized in the position shown in FIGS. 1 and 7. Moreover, the oblong opening 211 need not have any crushable zone whereas the other eleven openings 212 can have a curved crushable zone in a half of the opening 212.

Figure 8:
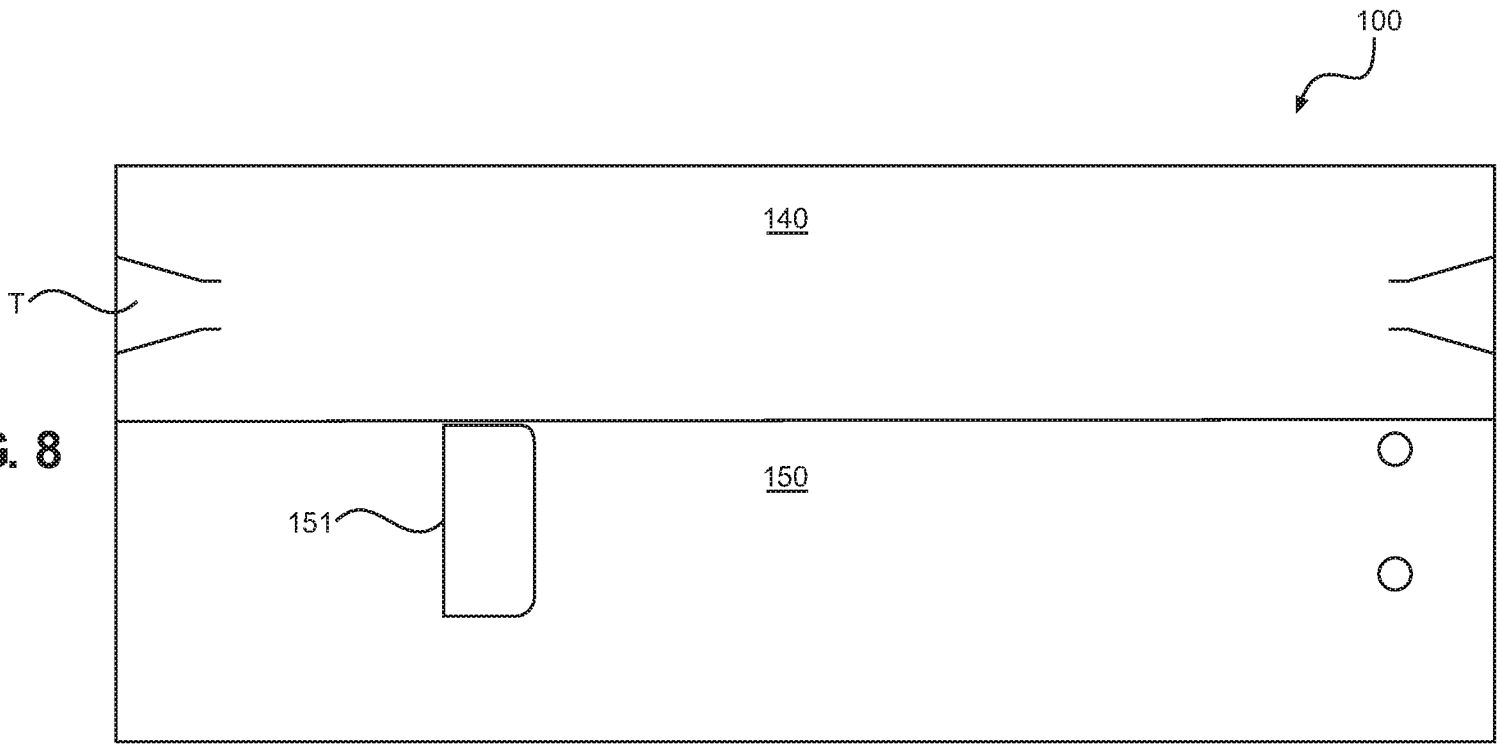
FIG. 8 shows a left-side view of the left-side or first insert member.
Figure 14:
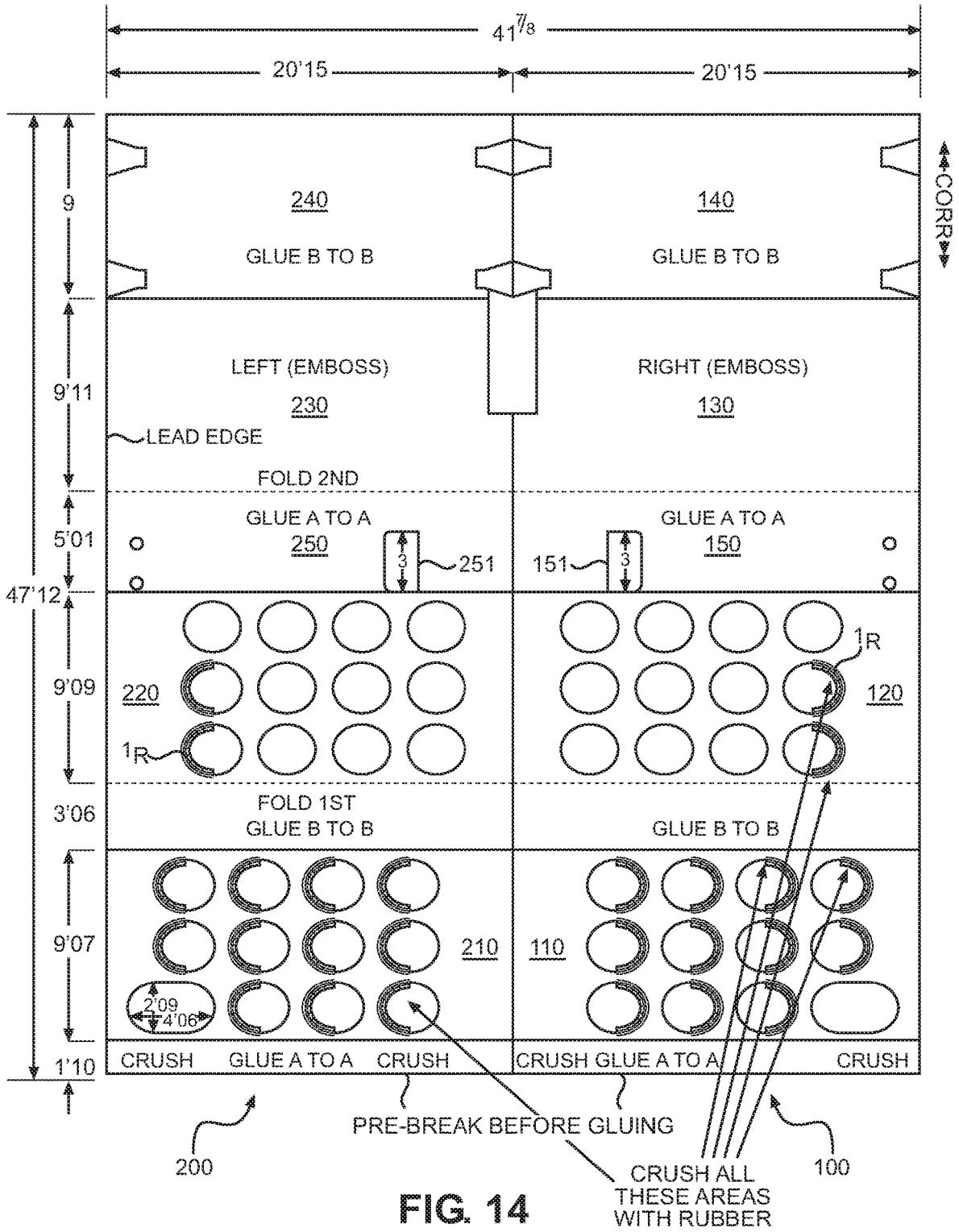
FIG. 14 shows a cardboard blank with dimensions (in inches) which forms both the left-side or first insert member and the right-side or second insert member.
Figure 16:
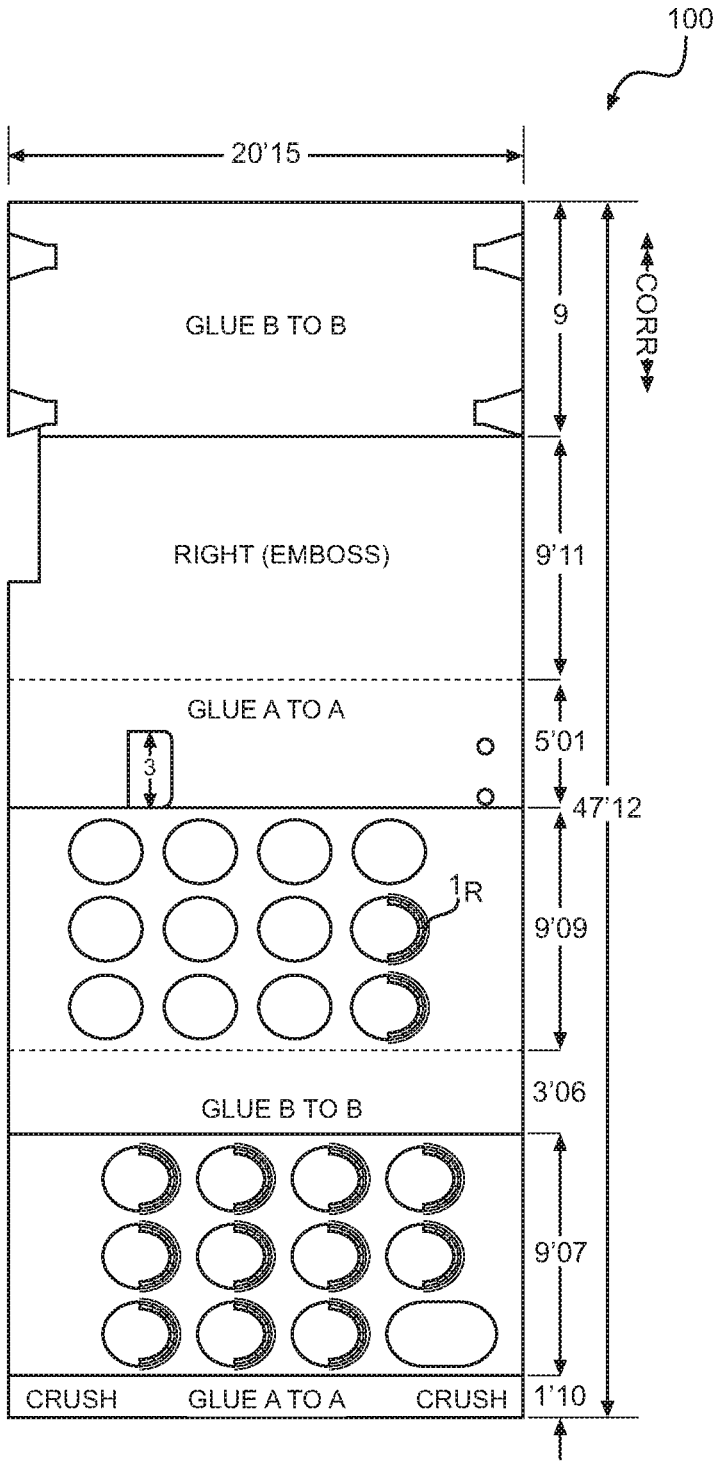
FIG. 16 shows the blank section of FIG. 14 that forms the left-side or first insert member.

With reference to FIGS. 8, 14 and 16, it can also be seen how the insert member 100 has a vertical outer panel or side 150 which includes an offset grip opening 151. In embodiments, the opening 151 is generally D-shaped and is located on the insert member 100 at a position that will align grip opening 151 with the box grip opening tab 321—which, when folded inward, will pass into opening 151 and be bent further (and upward when the box is in the position shown in FIG. 17) once inside the opening 151. The panel 150 is generally parallel to the vertically taller panel 140 and, whereas the panel 140 is configured to abut and contact panel 240, the panel 150 is sized and configured to abut and contact an inside of the side 320 of the box.

Figure 9:
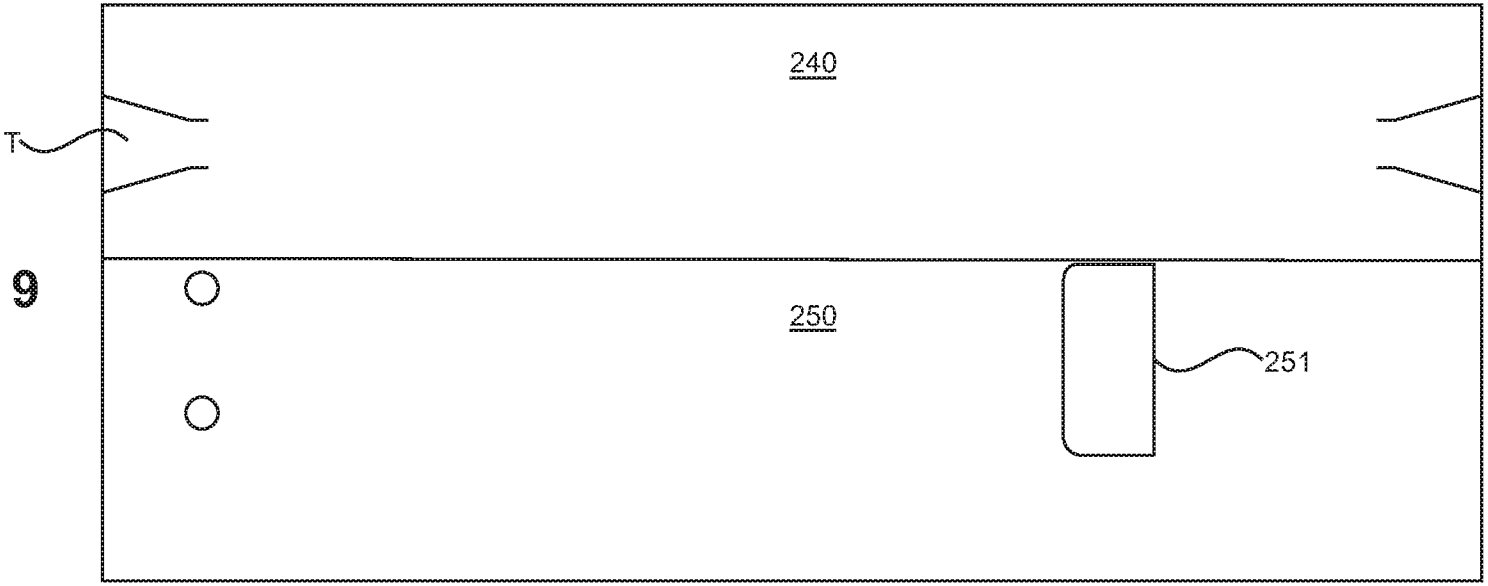
FIG. 9 shows a right-side view of the right-side or second insert member.
Figure 15:
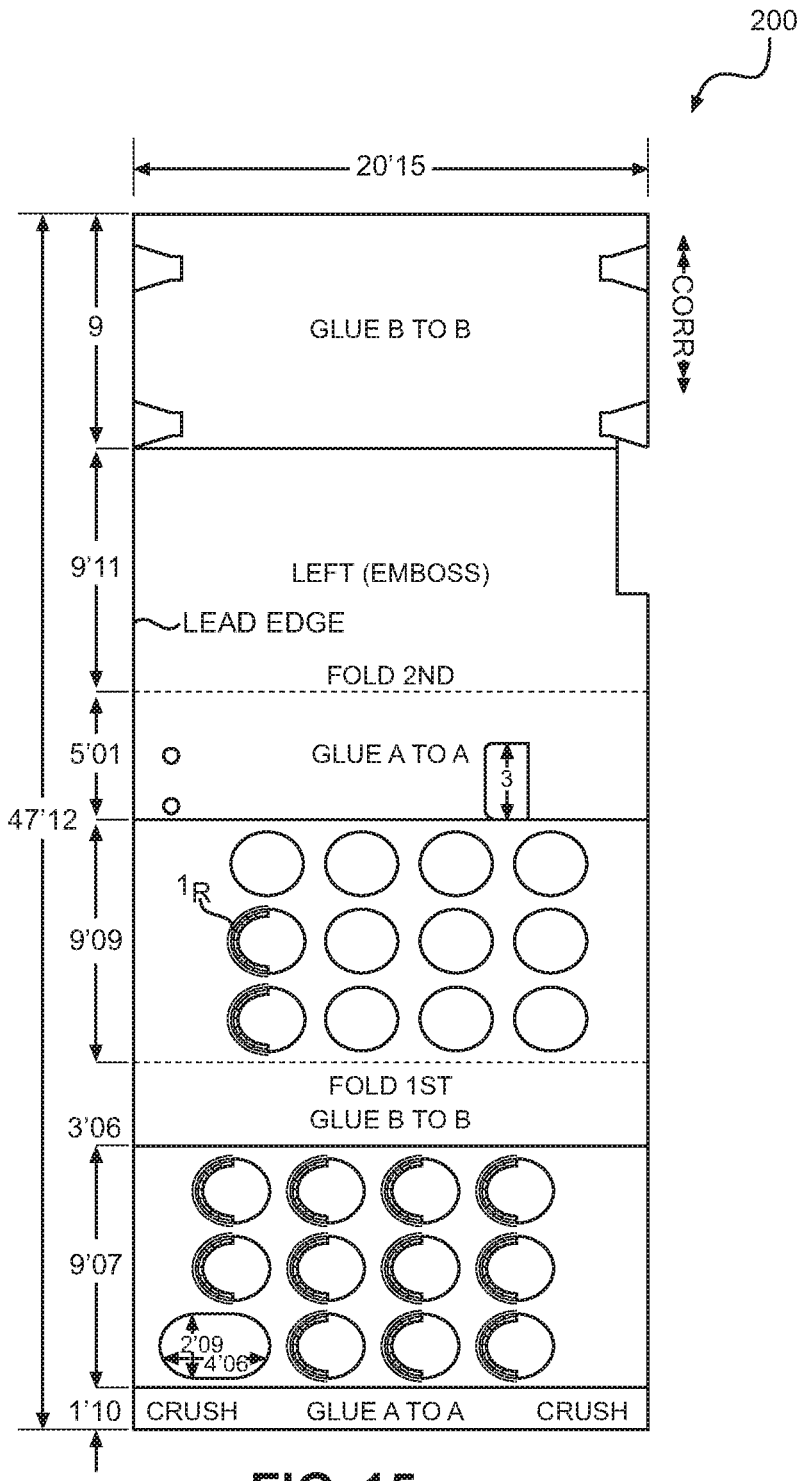
FIG. 15 shows the blank section of FIG. 14 that forms the right-side or second insert member.

With reference to FIGS. 9, 14 and 15, it can also be seen how the insert member 200 similarly has a vertical outer panel or side 250 which includes an offset grip opening 251. In embodiments, the opening 251 is generally D-shaped and is located on the insert member 200 at a position that will align grip opening 251 with the box grip opening tab 331—which, when folded inward, will pass into opening 251 and be bent further (and upward when the box is in the position shown in FIG. 17) once inside the opening 251. The panel 250 is generally parallel to the vertically taller panel 240 and, whereas the panel 240 is configured to abut and contact panel 140, the panel 250 is sized and configured to abut and contact an inside of the side 330 of the box.

Figure 12:
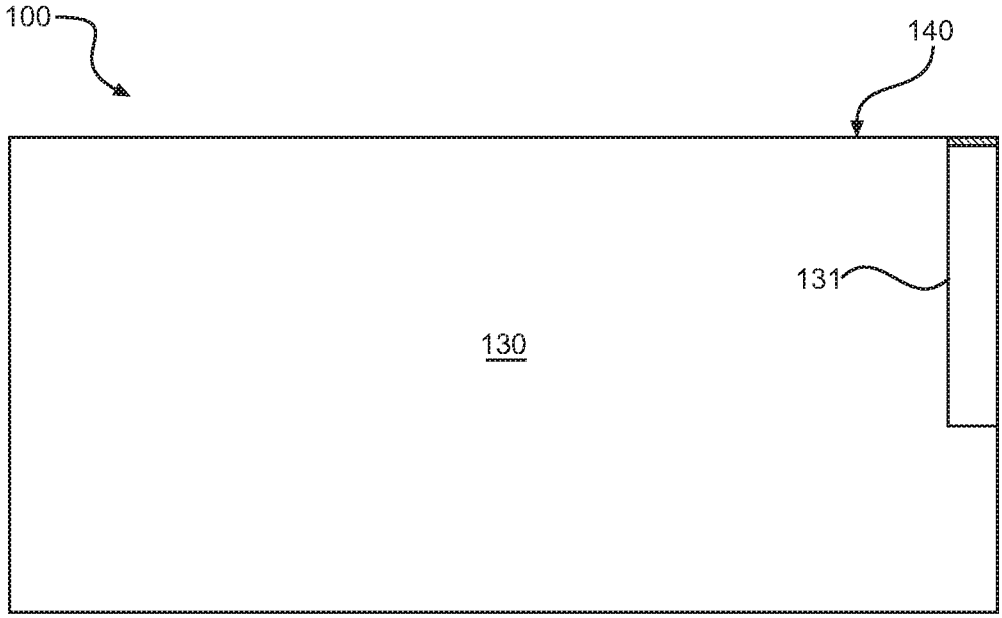
FIG. 12 shows a bottom view of the left-side or first insert member with the vertical panel side being on top.
Figure 13:
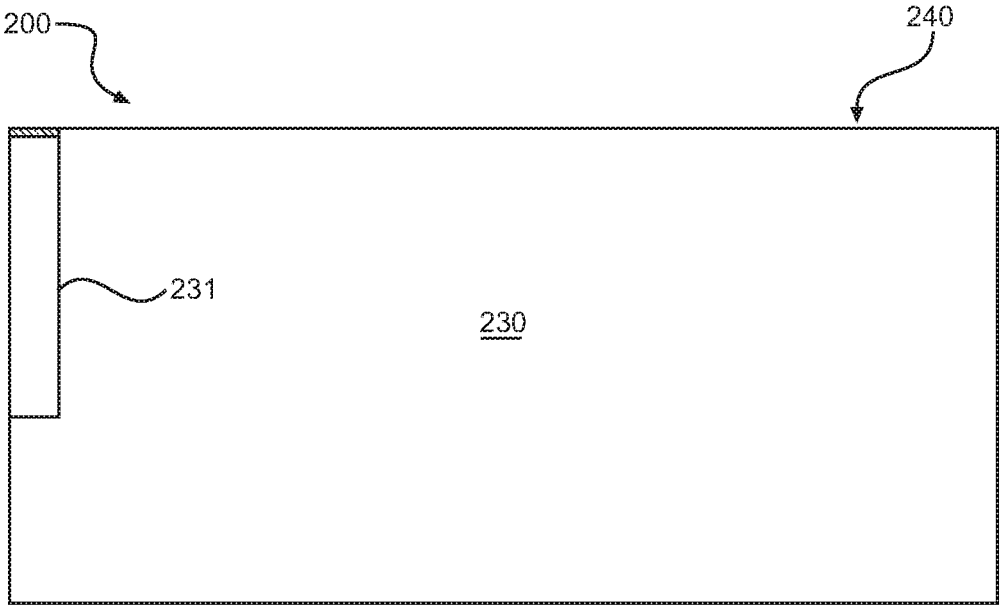
FIG. 13 shows a bottom view of the right-side or second insert member with the vertical panel side being on top.

With reference to FIGS. 12 and 13, it can also be seen how the insert members 100 and 200 respectively have bottom sides 130 and 230 which respectively includes a notch 131 and 231. Each notch 131 and 231 is offset and extends to the respective vertical panel 140 and 240.

With reference to FIGS. 14-16, it can also be seen how the insert members 100 and 200 are folded and secured in shape from blanks which have non-limiting exemplary dimensions. In FIG. 14, the right side blank 100' can be folded and glued in noted locations so as to form the insert member 100 and the left side blank 200' can be folded and glued in noted locations so as to form the insert member 200. The dimensions are in inches with the dimension 9' 11 equating to 9 inches and 11/16 inches. In embodiments, the material for the blanks is cardboard having a thickness of between 1/16 inch and 1/8 inch.

FIGS. 17-25 shows an exemplary packaging box that can house the insert assembly 10 along with 24 bottles and/or cans inserted in the insert assembly 10. The box 300 has a front side which includes twenty four removable box window panels or covers BWC. The box 300 has an equally sized back side 360, as well as oppositely arranged left and right sides 320 and 330 and oppositely arranged top and bottom sides 340 and 350. As the box shown in FIG. 17 can typically hold 24 bottles and/or cans containing a consumable product such as beer, the weight of the package can be substantial. The box and insert cooperate to ensure that the bottles and/or cans are not damaged during transport and use. However, one may still need to lift the box and this is facilitated by the grip openings and grip tabs 321 and 322 and grip openings and grip tabs 331 and 332. Indeed, with the grip tabs 321 and 331 being foldable into the openings 151 and 251 (compare FIGS. 23 and 24), one can lift the box 300 while also simultaneously lifting the insert assembly 10 disposed therein. This can occur, for example, when a consumer inserts a left hand into opening 322/151 and inserts a right hand into openings 332/251. The grip tabs 321 and 331 are configured to fold inwards and function to reinforce the grip openings of the box and insert.

Figure 17:
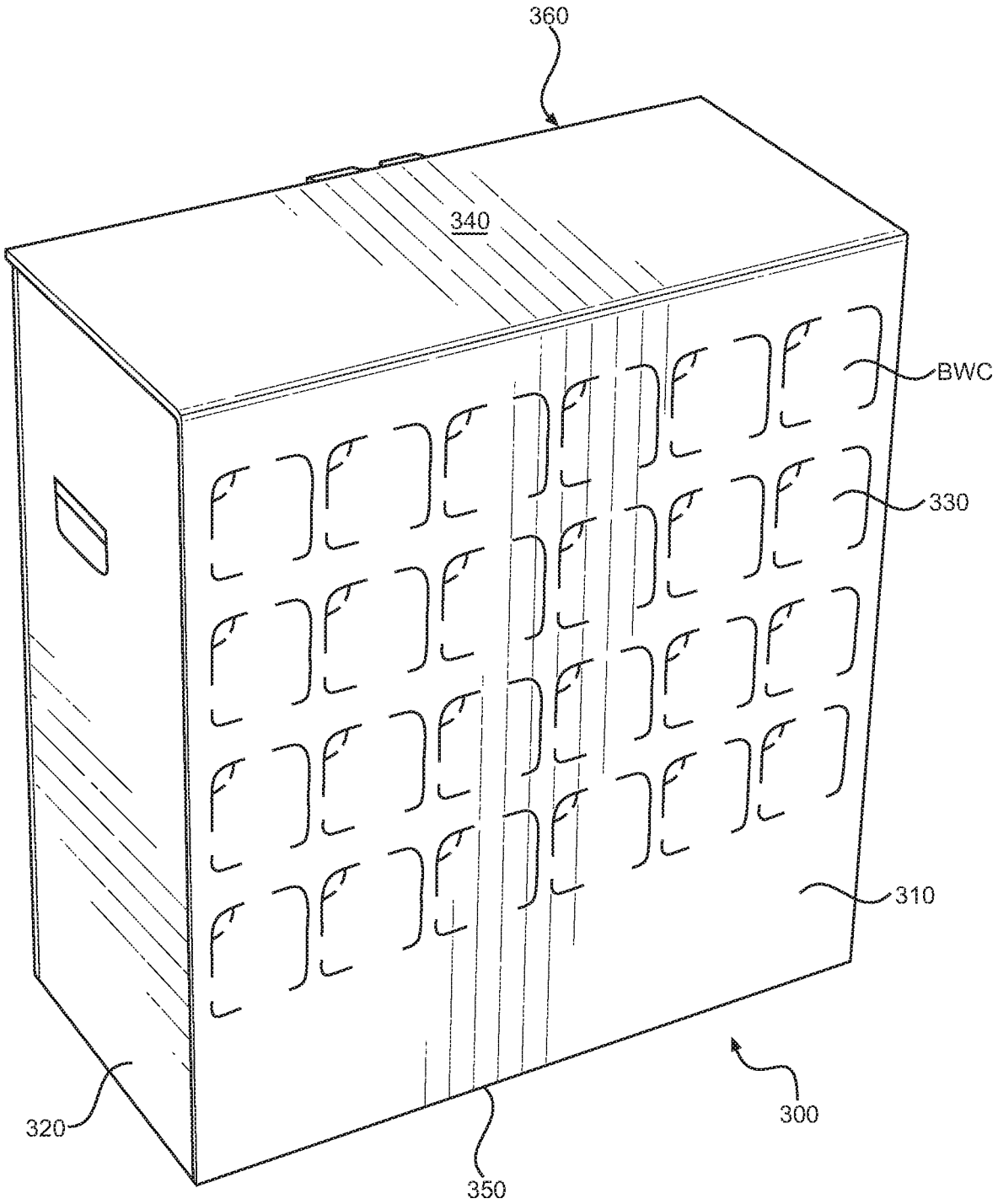
FIG. 17 shows a top front left side perspective view of a packaging container or box sized to retained or receive therein the packaging insert shown in FIG. 1.
Figure 18:
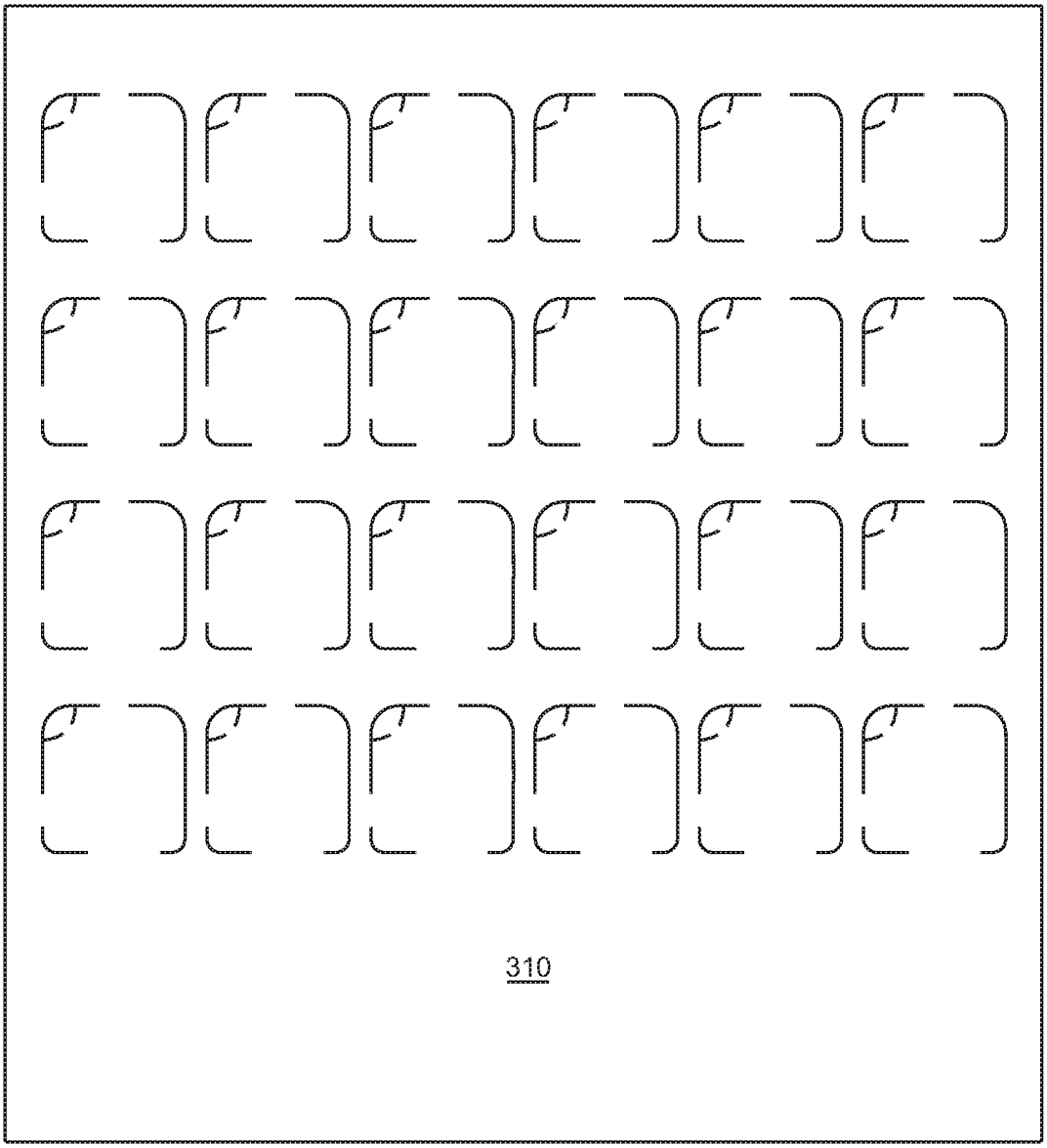
FIG. 18 shows a front view of the packaging container or box of FIG. 17.
Figure 19:
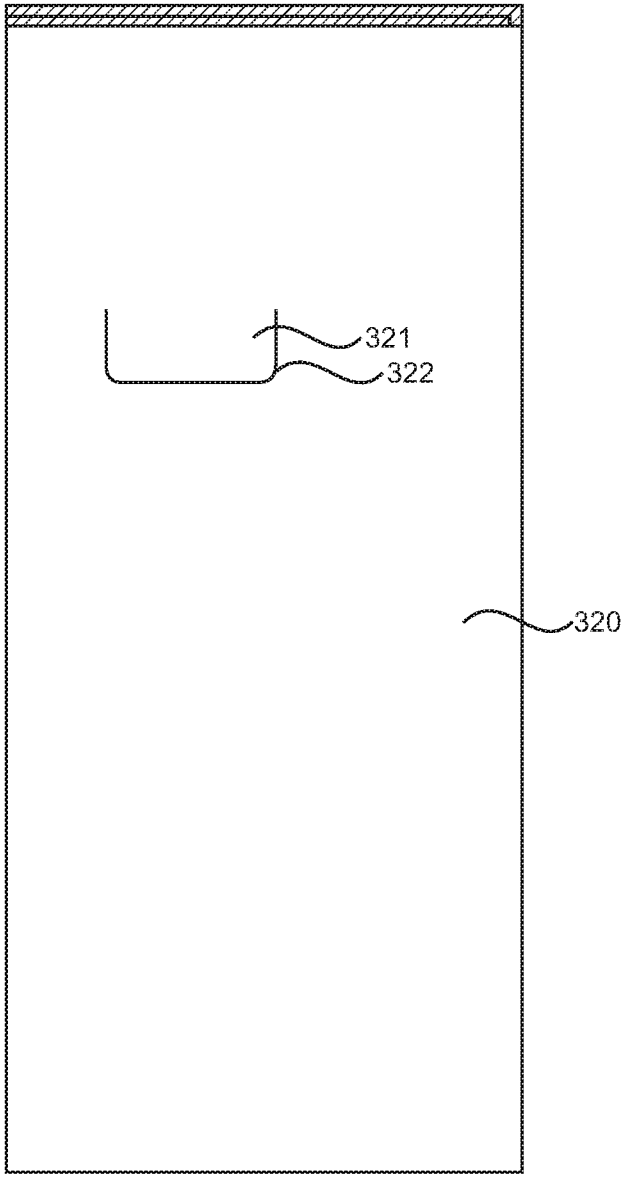
FIG. 19 shows a left-side view of the packaging container or box of FIG. 17.
Figure 20:
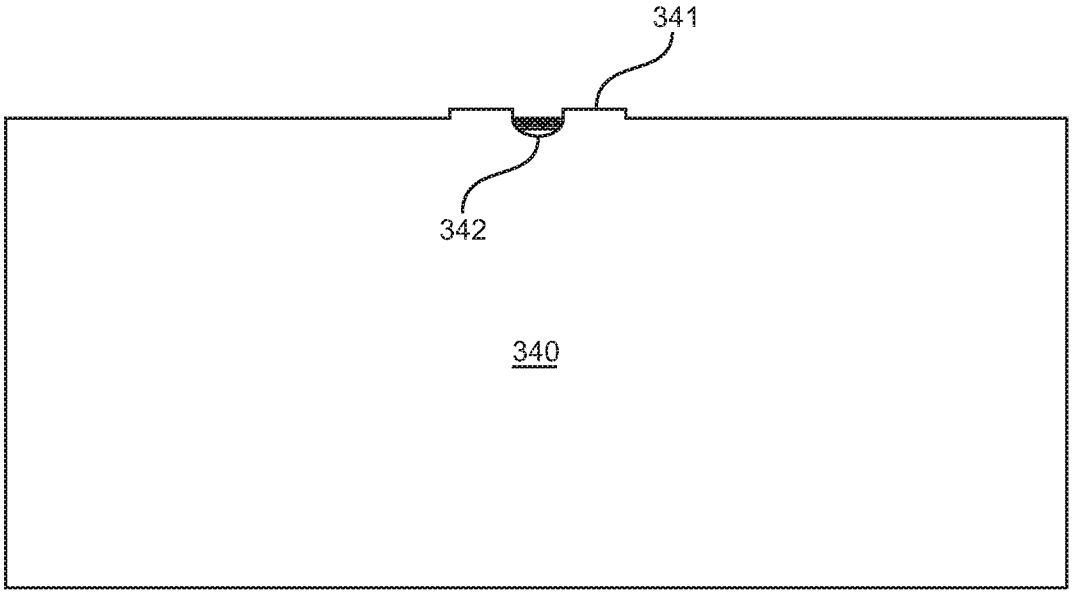
FIG. 20 shows a top view of the packaging container or box of FIG. 17 with the front of the box located at the bottom.
Figure 21:
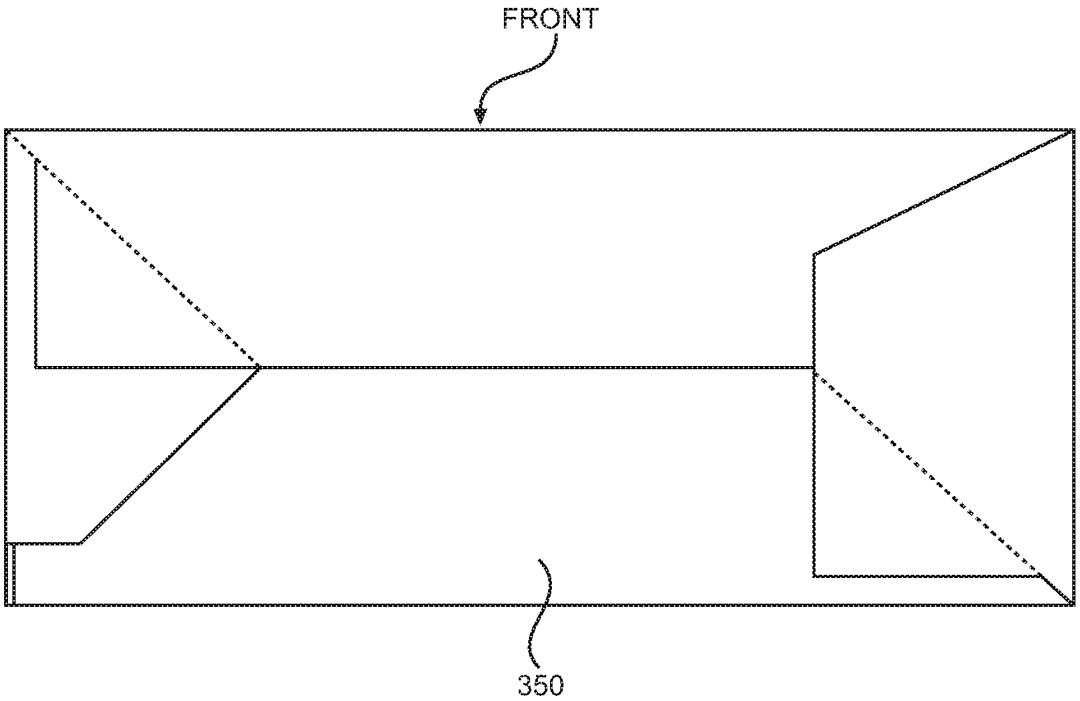
FIG. 21 shows a bottom view of the packaging container or box of FIG. 17.
Figure 22:
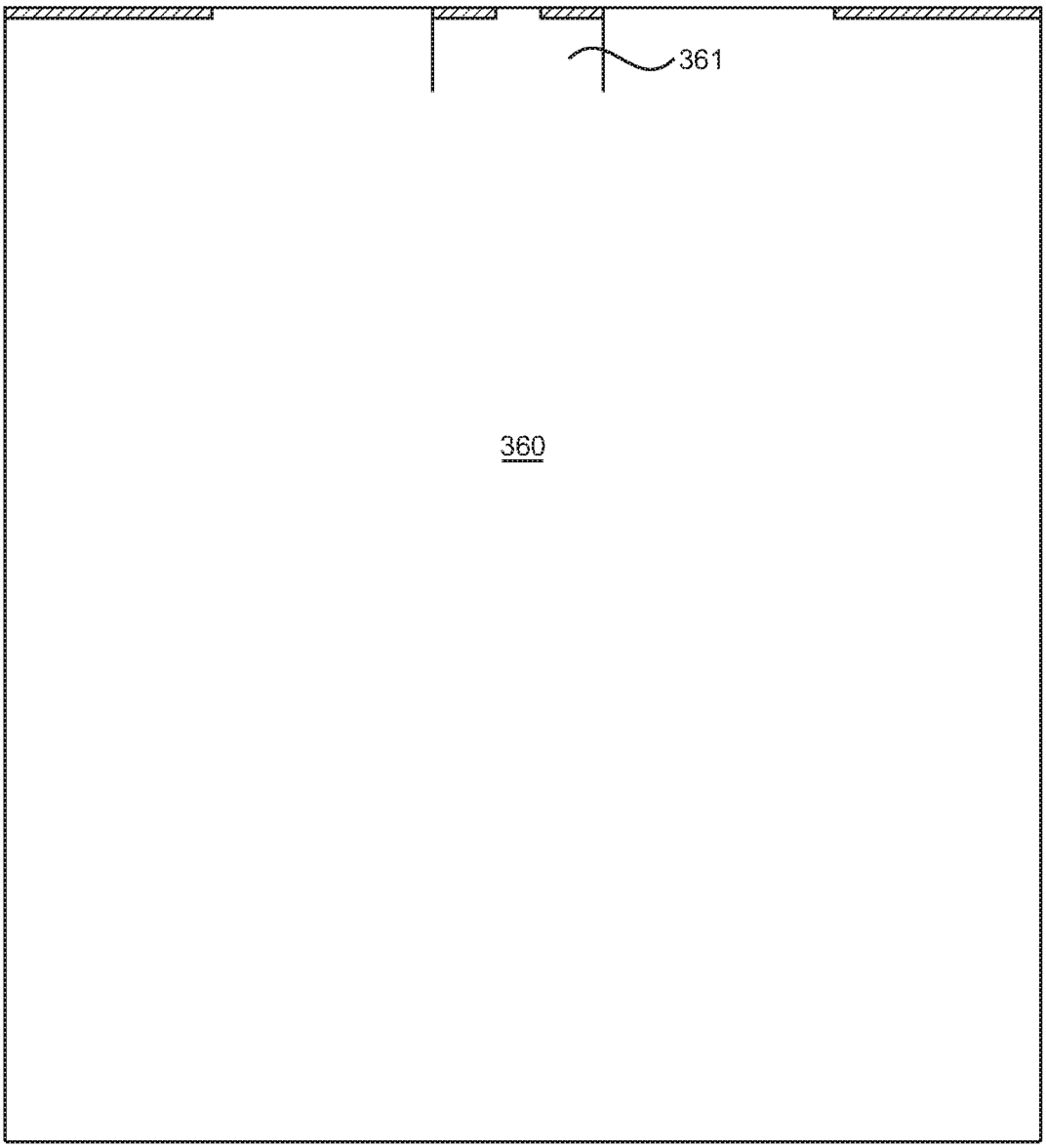
FIG. 22 shows a back view of the packaging container or box of FIG. 17.
Figure 24:
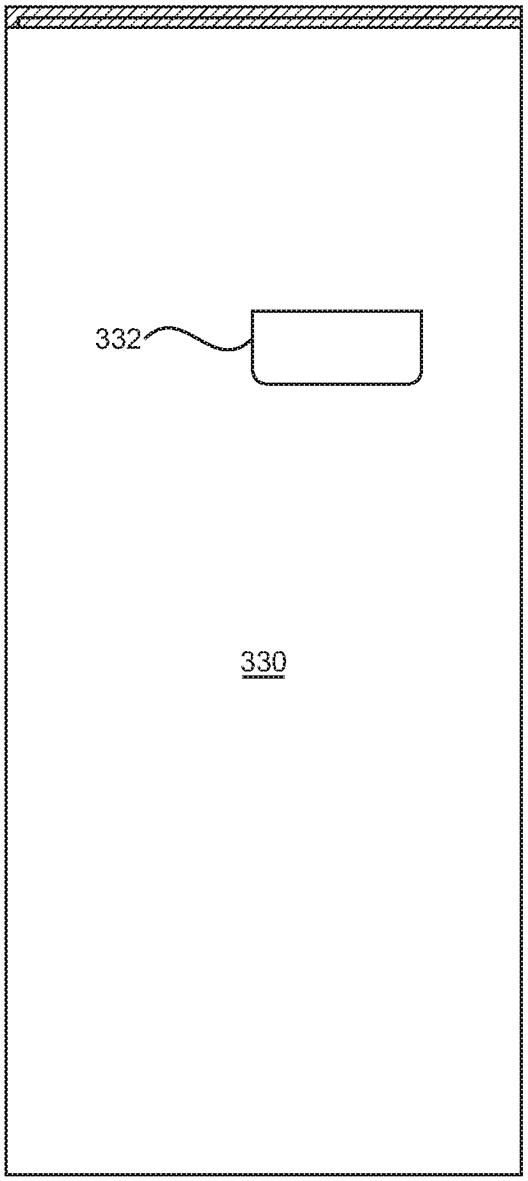
FIG. 24 shows the view of FIG. 23 after the hand-grip panel or tab is folded inward.
Figure 23:
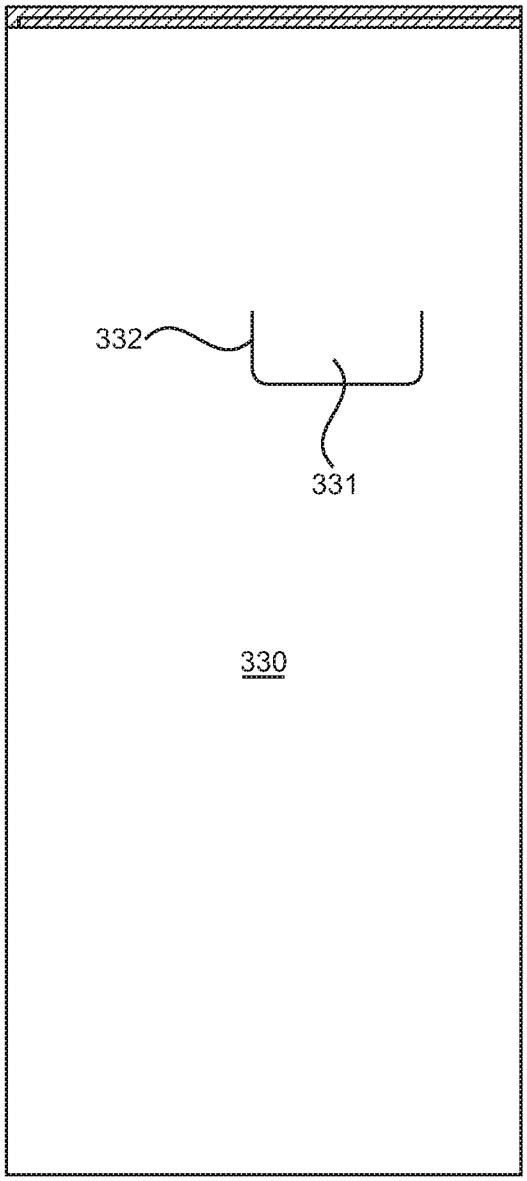
FIG. 23 shows a left side view of the packaging container or box of FIG. 17 before the hand-grip panel or tab is folded inward.

Each cover BWC is individually removable and overlies an upper end of a bottle or can be held in an inclined position. When a consumer first received the box package, all of the covers BWC are as shown in FIG. 17. As the packaging functions as an advent calendar, a consumer will typically remove a cover BWC that corresponds to a desired start date. This may typically be the cover BWC that is in the top row and starting from the left side. Once this cover BWC is removed, the consumer can slide out the bottle or can located underneath the cover BWC. The next day, the consumer can remove a cover BWC that is located to the right (and in the top row) of the previously removed cover BWC. Again, once this cover BWC is removed, the consumer can slide out the bottle or can located underneath the cover BWC. This can continue until all of the covers BWC are removed and the bottles and/or cans. If desired, the consumer can placed the empty bottles or cans back in the respective locations. As the covers BWC are typically discarded after removal, any of the twenty locations without covers BWC will typically have not contains position therein or will have empty containers. By observing which locations still have covers BWC in place a consumer will know (at a glance) how many bottles and/or cans remain inside the package.

Figure 25:
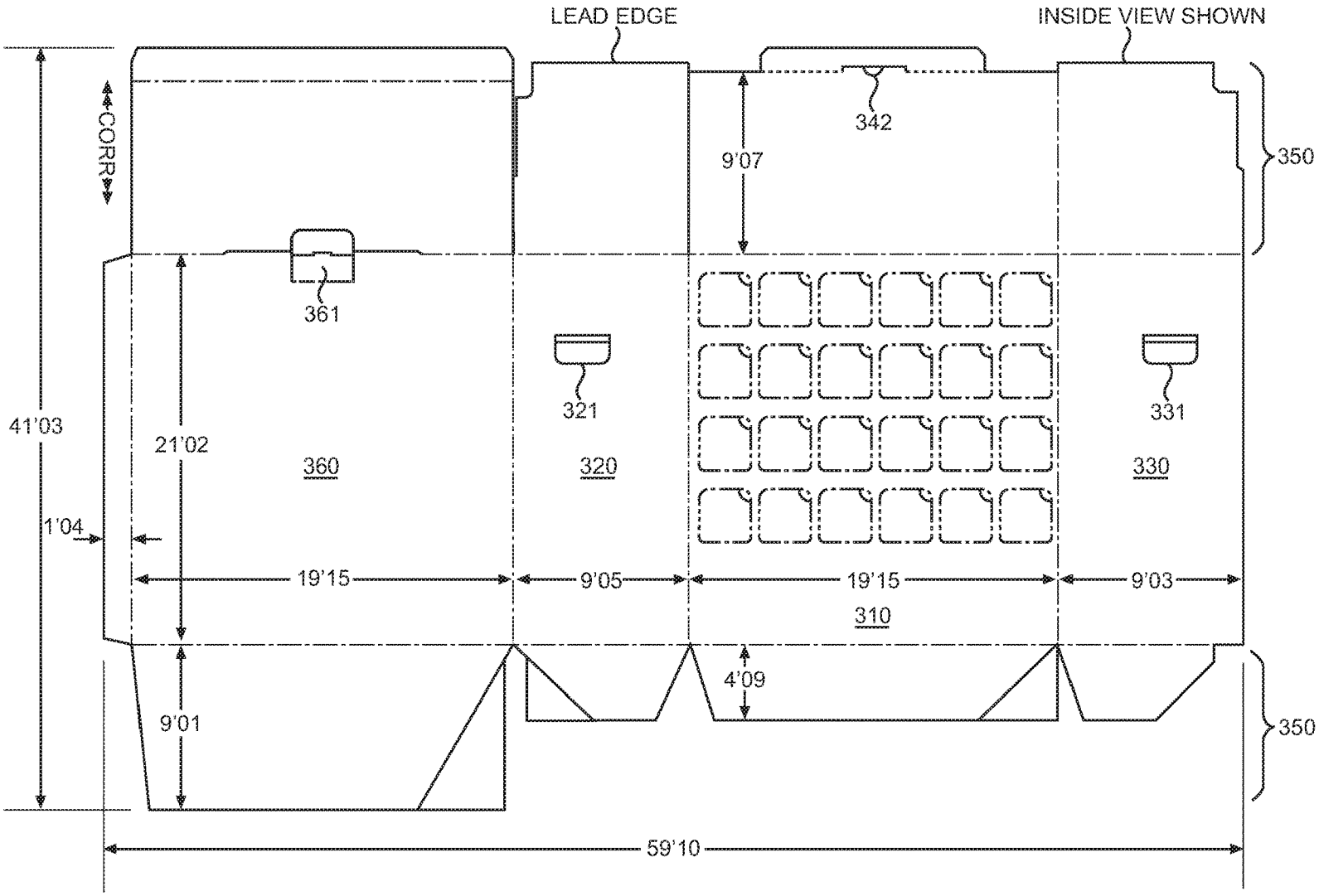
FIG. 25 shows a cardboard blank which can be folded to form the packaging container or box of FIG. 17.
Figure 26:
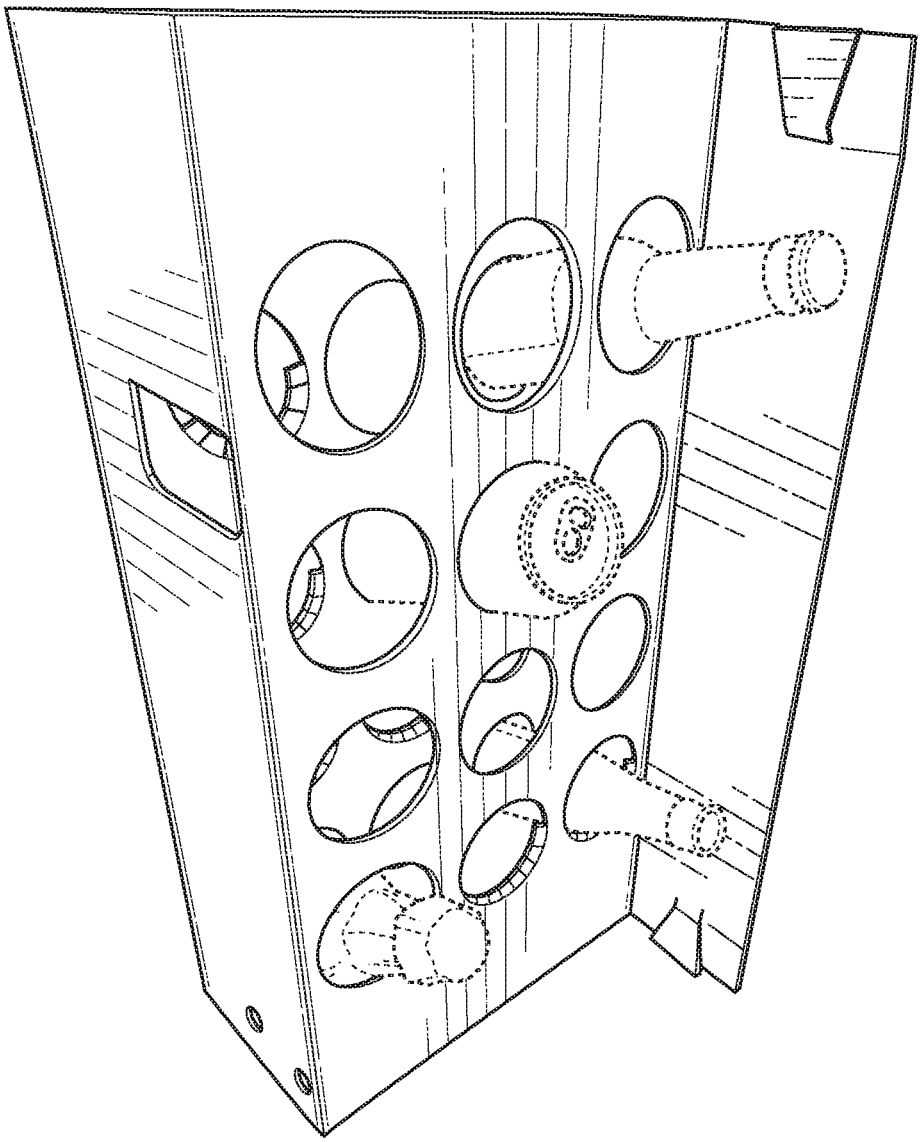
FIG. 26 shows how bottles or cans assume an angled orientation when installed in one of the insert members.

With reference to FIG. 25, it can also be seen how the box 300 is folded and secured in shape from a blank which has non-limiting exemplary dimensions and can be folded and glued in noted locations so as to form the box 300. The dimensions are in inches with the dimension 21' 02 equating to 21 inches and 2/16 inches. In embodiments, the material for the blanks is cardboard having a thickness of between 1/16 inch and 1/8 inch. As should be apparent from FIG. 25, the upper panels will form the top side 340 and the bottom panels will form the bottom side 350. While the bottom side 350 is glued together, the top side 340 is retained closed by locking tabs 341/342 and 361. The middle panels will form the front, back and left and right sides.

Non-Limiting Example

A packaging insert 10 includes a first insert member 100 having a connecting panel 140. A first layer 120 has generally oval-shaped first container receiving openings 122. A second layer 110 is spaced from the first layer 120 and has generally oval second container receiving openings 112. The first container receiving openings 122 are offset from the second container receiving openings 112. The first and second container receiving openings 122 and 112 are sized and configured to receive two different types of containers. A second insert member 200 includes a connecting panel 240 connectable to the connecting panel 140 of the first insert member 100 via foldable connecting tabs T. A first layer includes generally oval-shaped first container receiving openings 222. A second layer 210 is spaced from the first layer 220 and includes generally oval-shaped second container receiving openings 212. The first container receiving openings 222 are offset from the second container receiving openings 212. The first and second container receiving openings 222 and 212 are sized and configured to receive two different types of containers (such as bottle and cans). The first and second insert members 100/200 retain the containers (bottles or cans) in an inclined orientation and are insertable into a box 300 having removable window covers BWC sized and configured to allow removal of a container (bottles or cans) from inside the box 300.

Exemplary bottle sizes that can be packaged in the insert assembly include Longneck, Industry Standard Bottle, North American Longneck having a volume of 355 mL, Longneck, Standard with a volume of –341 mL, as well as all currently available 330 mL bottles, all 375 mL bottles, all 250 mL bottles and NRW 500 mL bottles. These can include closures made by crown cap, swing top, and cork and muselet.

Exemplary can sizes that can be packaged in the insert assembly include cans of volume 473 mL or of volume 500 mL.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCES

10 Assembled Packaging insert
100 Left Side or First Folded Insert
110 First or Intermediate Layer of Surface
111 First Type Opening
112 Second Type Opening
120 Second or Top Layer of Surface
121 First type Opening
122 Second type Opening
130 Third or Bottom Layer of Surface
131 Notch
140 Connecting Panel
150 Outer Panel
151 Grip Opening
200 Right Side or Second Folded Insert
210 First or Intermediate Layer of Surface
211 First Type Opening
212 Second Type Opening
220 Second or Top Layer of Surface
221 First type Opening
222 Second type Opening
230 Third or Bottom Layer of Surface
231 Notch
240 Connecting Panel
250 Outer Panel
251 Grip Opening
300 Packaging Container or Box
310 Front Side or Panel
320 Left Side or Panel
321 Box Grip Tab
322 Box Grip Opening
330 Right Side or Panel
331 Box Grip Tab
332 Box Grip Opening
340 Top Side or Panel
341 Locking Portion
342 Finger Notch
350 Bottom Side or Panel
360 Back Side or Panel
361 Locking Portion
T Locking Tab
TO Tab Opening
BWC Box Window Cover

What is claimed is:

1. A packaging insert comprising:

first and second insert members each comprising:

a first horizontal layer or surface comprising a plural number of first container receiving openings;

a second horizontal layer or surface spaced vertically from the first layer or surface and comprising a plural number of second container receiving openings, wherein the plural number of first container receiving openings is equal to the plural number of second container receiving openings;

a vertical layer or surface arranged adjacent the first horizontal layer or surface and the second horizontal layer or surface, the vertical layer or surface projecting beyond the first horizontal layer or surface in a first vertical direction and projecting beyond the second horizontal layer or surface in a second vertical direction opposite to the first vertical direction, the first horizontal layer or surface having a first length and the vertical layer or surface having a second length, wherein the first length is greater than the second length;

said plural number of first container receiving openings being partially overlapped with, and horizontally offset from, said plural number of second container receiving openings so as to retain a received container in an inclined orientation relative to a vertical axis extending perpendicularly through the first and second horizontal layers or surfaces when the container extends between and is received into both a respective first container receiving opening and a respective second receiving opening; and at least one of the plural number of first container receiving openings being sized and configured to receive two different types of containers.

2. The packaging insert of claim 1, wherein the first and second layers or surfaces are made of cardboard or fiberboard.

3. The packaging insert of claim 1, wherein the first and second layers or surfaces are made of folded sheet material.

4. The packaging insert of claim 1, wherein the first and second insert members comprise left-side and right-side insert members arranged side-by-side.

5. The packaging insert of claim 4, wherein the left-side and right-side insert members are configured to be assembled together.

6. The packaging insert of claim 4, wherein the left-side and right-side insert members have folded configurations that are substantial mirror images of one another.

7. The packaging insert of claim 4, wherein the left-side and right-side insert members are folded from blanks that are substantial mirror images of one another.

8. The packaging insert of claim 1, wherein the at least one first container opening comprises plural container receiving openings.

9. The packaging insert of claim 8, wherein the at least one second container opening comprises plural container receiving openings.

10. The packaging insert of claim 1, wherein the at least one first container opening comprises 12 container receiving openings, whereby the first and second insert members together comprise 24 container receiving openings.

11. The packaging insert of claim 1, wherein the packaging insert is configured to store beer containers.

12. The packaging insert of claim 1, wherein the packaging insert is configured to be disposed in a box having an advent calendar.

13. The packaging insert of claim 1, wherein the two different types of containers comprise beverage cans and beverage bottles.

14. The packaging insert according to claim 1, wherein at least one of said at least one first container receiving opening and said at least one second container receiving opening is oval.

15. An advent calendar package configured to store cans and bottles during shipping and use, comprising:

a box comprising plural removable sections, each removable section being sized and configured to allow for removal of one bottle or one can stored inside the box; and a packaging insert of claim 1 arranged inside the box.

16. The advent calendar package of claim 15, wherein the box contains therein beer cans and/or beer bottles.

17. A two-piece packaging insert comprising:

a right-side cardboard or fiberboard insert and a left-side cardboard or fiberboard insert, the left-side insert comprising:

seven rectangular sections that include;

a first rectangular section having four foldable connecting tabs and four corresponding openings arranged along respective side edges at approximate corner regions of the first rectangular section, each of the foldable connecting tabs having a tapering width that narrows from its respective side edge;

a second rectangular section;

a fold line connecting the first and second rectangular sections such that the first and second rectangular sections directly contact each other;

a third rectangular section comprising a handle opening;

a fold line connecting the second and third rectangular sections such that the second and third rectangular sections directly contact each other;

a fourth rectangular section comprising at least one first container receiving opening and forming a left-side half of a first layer or surface;

a fold line connecting the third and fourth rectangular sections such that the third and fourth rectangular sections directly contact each other;

a fifth rectangular section;

a fold line connecting the fourth and fifth rectangular sections such that the fourth and fifth rectangular sections directly contact each other;

a sixth rectangular section comprising at least one second container receiving opening;

a fold line connecting the fifth and sixth rectangular sections such that the fifth and sixth rectangular sections directly contact each other;

a seventh rectangular section; and a fold line connecting the sixth and seventh rectangular sections such that the sixth and seventh rectangular sections directly contact each other.

18. The two-piece packaging insert according to claim 17, wherein at least one of said at least one first container receiving opening and said at least one second container receiving opening is oval.

19. A packaging insert insertable into a box container and configured to safely retain bottles or cans during transport, the packing insert comprising:

a first folded insert member comprising:

three vertically spaced apart parallel horizontal walls having a width and a longer length;

two of said three walls having container receiving openings partially overlapped with, and being horizontally offset from, each other so as to retain a container in an inclined orientation relative to a vertical axis extending perpendicularly through the three horizontal walls when the container extends between, and is received in, the container receiving openings;

a vertical sidewall oriented in a length direction and having a vertical height in a vertical direction that is greater than a vertical span of the three spaced apart parallel horizontal walls, and having four foldable connecting tabs and four corresponding openings arranged at approximate corner regions of the vertical sidewall, with two of the foldable connecting tabs and corresponding openings arranged below both of the two walls having the container receiving openings in the vertical direction, and two of the foldable connecting tabs and corresponding openings arranged above both of the two walls having the container receiving openings in the vertical direction; and a hand-hold opening configured to align with a hand-hold opening in the box container;

a second folded insert member comprising:

three vertically spaced apart parallel horizontal walls having a width and a longer length;

two of said three walls having container receiving openings partially overlapped with, and being horizontally offset from, each other so as to retain a container in an inclined orientation relative to a vertical axis extending perpendicularly through the three horizontal walls when the container extends between, and is received in, the container receiving openings;

a vertical sidewall oriented in a length direction and having a vertical height that is greater than a vertical span of the three spaced apart parallel horizontal walls, and having four foldable connecting tabs and four corresponding openings arranged along respective side edges at approximate corner regions of the vertical sidewall, with two of the foldable connecting tabs and corresponding openings arranged below both of the two walls having the container receiving openings in the vertical direction, and two of the foldable connecting tabs and corresponding openings arranged above both of the two walls having the container receiving openings in the vertical direction; and a hand-hold opening configured to align with a hand-hold opening in the box container, wherein each of the foldable connecting tabs has a tapering width that narrows from a respective side edge of the vertical side wall.

20. The packaging insert according to claim 19, wherein one or more of said container receiving openings of said first folded insert member is oblong and wherein one or more of said container receiving openings of said second folded insert member is oval.

* * * * *